US012703058B2

(12) United States Patent
Kimba et al.

(10) Patent No.: US 12,703,058 B2
(45) Date of Patent: Aug. 11, 2026

(54) SURFACE PROPERTY MEASURING SYSTEM, SURFACE PROPERTY MEASURING METHOD, POLISHING APPARATUS, AND POLISHING METHOD

(71) Applicant: EBARA CORPORATION, Tokyo (JP)

(72) Inventors: Toshifumi Kimba, Tokyo (JP); Kohei Ohshima, Tokyo (JP); Kohei Ota, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 616 days.

(21) Appl. No.: 18/137,280

(22) Filed: Apr. 20, 2023

(65) Prior Publication Data

US 2024/0075580 A1 Mar. 7, 2024

(30) Foreign Application Priority Data

Apr. 26, 2022 (JP) ..... 2022-072241
Jan. 25, 2023 (JP) ..... 2023-009590

(51) Int. Cl.
*B24B 37/013* (2012.01)
*B24B 49/04* (2006.01)
*B24B 49/08* (2006.01)
*B24B 49/12* (2006.01)

(52) U.S. Cl.
CPC ..... *B24B 37/013* (2013.01); *B24B 49/045* (2013.01); *B24B 49/08* (2013.01); *B24B 49/12* (2013.01)

(58) Field of Classification Search
CPC ..... B24B 37/013; B24B 49/045; B24B 49/08; B24B 49/12; G01B 11/30; G01N 21/956
See application file for complete search history.

(56) References Cited

U.S. PATENT DOCUMENTS 3,020,579 A * 2/1962 O'Connor ..... B05C 17/00 118/410
6,340,122 B1 * 1/2002 Kamstrup-Larsen ..... B05C 5/0279 239/548
2021/0370461 A1 * 12/2021 Kamiki ..... B24B 37/005

FOREIGN PATENT DOCUMENTS

JP 2015-174156 A 10/2015

* cited by examiner

*Primary Examiner* — Stephen D Meier
*Assistant Examiner* — Quang X Nguyen
(74) *Attorney, Agent, or Firm* — BakerHostetler

(57) ABSTRACT

A surface property measuring system capable of accurately measuring a surface property of a polishing pad without damaging the polishing pad and without reducing throughput of the entire polishing process is disclosed. The surface property measuring system includes: an optical measuring device configured to direct light to a polishing surface of a polishing pad when the polishing pad is rotating, and measure a surface property of the polishing pad based on reflected light from the polishing surface; a cover member disposed between the optical measuring device and the polishing pad; and a transparent-liquid supply line coupled to an inlet port provided in the cover member and configured to supply a transparent liquid onto the polishing pad through the inlet port. The cover member has a light transmissive portion on an optical path of the light and the reflected light.

29 Claims, 22 Drawing Sheets

SURFACE PROPERTY MEASURING SYSTEM, SURFACE PROPERTY MEASURING METHOD, POLISHING APPARATUS, AND POLISHING METHOD

CROSS REFERENCE TO RELATED APPLICATION

This document claims priorities to Japanese Patent Application No. 2022-072241 filed Apr. 26, 2022, and Japanese Patent Application No. 2023-009590 filed Jan. 25, 2023, the entire contents of which are hereby incorporated by reference.

BACKGROUND

A planarization technique for a surface of a semiconductor device has been increasingly important in a manufacturing process of semiconductor devices. The most important technique in this surface planarization is chemical mechanical polishing (CMP). The chemical mechanical polishing (hereafter referred to as CMP) is a process of polishing a substrate, such as a wafer, by placing the substrate in sliding contact with a polishing surface of a polishing pad while supplying a polishing liquid containing abrasive grains, such as silica ($SiO_2$), onto the polishing surface.

A polishing apparatus for performing CMP includes a polishing table that supports a polishing pad having a polishing surface, and a polishing head configured to hold a substrate and press the substrate against the polishing pad. The polishing apparatus polishes the substrate as follows. While the polishing table and the polishing pad are rotated together, a polishing liquid (typically slurry) is supplied onto the polishing surface of the polishing pad. The polishing head presses a surface of the substrate against the polishing surface of the polishing pad while rotating the substrate. The substrate is brought into sliding contact with the polishing pad in the presence of the polishing liquid. The surface of the substrate is polished by a chemical action of the polishing liquid and mechanical action(s) of the polishing pad and/or the abrasive grains contained in the polishing liquid.

After polishing of the substrate, abrasive grains and polishing debris are attached to the polishing surface of the polishing pad, and polishing performance deteriorates. Thus, dressing (conditioning) of the polishing pad by a dresser is performed to regenerate the polishing surface of the polishing pad. The dresser has hard abrasive grains, such as diamond particles fixed to a lower surface of the dresser, and the dresser regenerates the polishing surface of the polishing pad by scraping away the polishing surface of the polishing pad.

The polishing pad is gradually worn as the substrate is repeatedly polished and the dressing operation is repeatedly performed. In addition, the polishing debris or other particle attaches to the surface of the polishing pad. Such a change in a surface property of the polishing pad causes deterioration of the polishing performance of the polishing pad, and as a result, a polishing rate of the substrate decreases. In view of this, the surface property of the polishing pad is measured.

The surface property of the polishing pad is measured by an optical measuring method, in which light is directed onto the surface of the polishing pad and the surface property is measured based on reflected light. Presence of the polishing liquid or the polishing debris on an optical path during measuring may cause a failure in accurate measuring of the surface property of the polishing pad. Thus, in order to remove the polishing liquid or the polishing debris in the optical path during measuring and to obtain the surface property of the polishing pad under a wet condition which is an actual polishing condition, the surface property is measured in the presence of a liquid film formed on the surface of the polishing pad.

Japanese laid-open patent publication No. 2015-174156 discloses a method of measuring a surface property of a polishing pad based on light from the polishing pad, while a liquid film having a certain thickness is formed by a weir to thereby eliminate an unstable gas-liquid interface on an optical path. However, the method disclosed in Japanese laid-open patent publication No. 2015-174156 requires the installation and removal of the weir after polishing of a substrate and before polishing of a next substrate. Therefore, a throughput of the entire polishing process is reduced. In addition, the contact of the weir with the polishing pad may cause an impurity to attach to the polishing pad, and may cause a defect in the polishing of the substrate.

SUMMARY

There are provided a surface property measuring system and a surface property measuring method capable of accurately measuring a surface property of a polishing pad in a short time without damaging the polishing pad. There are further provided a polishing apparatus including such a surface property measuring system and a polishing method using the surface property measuring method.

Embodiments, which will be described below, relate to a surface property measuring system and a surface property measuring method for measuring a surface property of a polishing pad for polishing a substrate, such as a wafer, and further relate to a polishing apparatus including such a surface property measuring system and a polishing method using the surface property measuring method.

In an embodiment, there is provided a surface property measuring system comprising: an optical measuring device configured to direct light to a polishing surface of a polishing pad when the polishing pad is rotating, and measure a surface property of the polishing pad based on reflected light from the polishing surface; a cover member disposed between the optical measuring device and the polishing pad, the cover member having a light transmissive portion on an optical path of the light and the reflected light; and a transparent-liquid supply line coupled to an inlet port provided in the cover member, the transparent-liquid supply line being configured to supply a transparent liquid onto the polishing pad through the inlet port.

In an embodiment, the inlet port is located upstream of the light transmissive portion in a rotating direction of the polishing pad.

In an embodiment, the inlet port is located downstream of the light transmissive portion in a rotating direction of the polishing pad.

In an embodiment, the surface property measuring system further comprises a supply flow-rate regulating valve configured to be able to regulate a flow rate of the transparent liquid to be supplied from the transparent-liquid supply line.

In an embodiment, the surface property measuring system further comprises a transparent-liquid suction line coupled to a suction port provided in the cover member, the transparent-liquid suction line being configured to suck the transparent liquid on the polishing pad through the suction port.

In an embodiment, the surface property measuring system further comprises a suction flow-rate regulating valve configured to be able to regulate a flow rate of the transparent liquid to be sucked by the transparent-liquid suction line.

In an embodiment, the cover member has a facing surface parallel to the polishing surface of the polishing pad.

In an embodiment, a distance from the polishing surface of the polishing pad to the facing surface is 5 mm or less.

In an embodiment, the surface property measuring system further comprises a cover-member height adjusting mechanism configured to adjust a height of the cover member with respect to the polishing surface.

In an embodiment, the surface property measuring system further comprises an imaging device configured to generate an image of a monitoring region including a measurement point on the polishing surface where the light is applied and the light is reflected.

In an embodiment, the surface property measuring system further comprises: a supply flow-rate regulating valve configured to be able to regulate a flow rate of the transparent liquid to be supplied from the transparent-liquid supply line; and an operation controller configured to control an operation of the supply flow-rate regulating valve based on the image of the monitoring region.

In an embodiment, the surface property measuring system further comprises: a transparent-liquid suction line coupled to a suction port provided in the cover member, the transparent-liquid suction line being configured to suck the transparent liquid on the polishing pad through the suction port; and a suction flow-rate regulating valve configured to be able to regulate a flow rate of the transparent liquid to be sucked by the transparent-liquid suction line, wherein the operation controller is configured to control an operation of the suction flow-rate regulating valve based on the image of the monitoring region.

In an embodiment, the operation controller is configured to generate an alarm when the operation controller detects an abnormality in a flow of the transparent liquid on the polishing pad based on the image of the monitoring region.

In an embodiment, the surface property measuring system further comprises: a first prism disposed between the optical measuring device and the cover member, the first prism being configured to allow the light from the optical measuring device to pass therethrough and deflect an optical path of the light, a second prism disposed between the optical measuring device and the cover member, the second prism being configured to allow the reflected light from the polishing surface to pass therethrough and deflect an optical path of the reflected light; and a light shielding member disposed between the first prism and the second prism, the light shielding member being configured to block light between the first prism and the second prism, wherein the cover member includes a first cover member configured to allow the light from the optical measuring device to pass therethrough, and the second cover member configured to allow the reflected light from the polishing surface to pass therethrough, and the light shielding member is disposed between the first cover member and the second cover member, and is configured to block light between the first cover member and the second cover member.

In an embodiment, there is provided a polishing apparatus comprising: the above-mentioned surface property measuring system; a polishing table configured to support the polishing pad; a table motor configured to rotate the polishing table together with the polishing pad; and a polishing head configured to press a substrate against the polishing surface of the polishing pad to polish the substrate.

In an embodiment, there is provided a surface property measuring method comprising: rotating a polishing table together with a polishing pad which is supported by the polishing table; supplying a transparent liquid onto the polishing pad through an inlet port provided in a cover member, the cover member being disposed between an optical measuring device and the polishing pad and having a light transmissive portion; and directing light to a polishing surface of the polishing pad through the light transmissive portion, receiving reflected light from the polishing surface through the light transmissive portion, and measuring a surface property of the polishing pad based on the reflected light by the optical measuring device.

In an embodiment, the inlet port is located upstream of the light transmissive portion in a rotating direction of the polishing pad.

In an embodiment, the inlet port is located downstream of the light transmissive portion in a rotating direction of the polishing pad.

In an embodiment, the surface property measuring method further comprises regulating a flow rate of the transparent liquid to be supplied onto the polishing pad.

In an embodiment, the surface property measuring method further comprises sucking the transparent liquid on the polishing pad through a suction port provided in the cover member, while supplying the transparent liquid onto the polishing pad through the inlet port.

In an embodiment, the surface property measuring method further comprises regulating a flow rate of the transparent liquid to be sucked from the polishing pad.

In an embodiment, the cover member has a facing surface parallel to the polishing surface of the polishing pad.

In an embodiment, a distance from the polishing surface of the polishing pad to the facing surface is 5 mm or less.

In an embodiment, the surface property measuring method further comprises adjusting a height of the cover member with respect to the polishing surface.

In an embodiment, the surface property measuring method further comprises generating an image of a monitoring region including a measurement point on the polishing surface where the light is applied and the light is reflected.

In an embodiment, the surface property measuring method further comprises regulating a flow rate of the transparent liquid to be supplied onto the polishing pad based on the image of the monitoring region.

In an embodiment, the surface property measuring method further comprises sucking the transparent liquid on the polishing pad through a suction port provided in the cover member, while supplying the transparent liquid onto the polishing pad through the inlet port; and regulating a flow rate of the transparent liquid to be sucked from the polishing pad based on the image of the monitoring region.

In an embodiment, the surface property measuring method further comprises generating an alarm when an abnormality in a flow of the transparent liquid on the polishing pad is detected based on the image of the monitoring region.

In an embodiment, there is provided a polishing method comprising: polishing a substrate with use of a polishing pad; and measuring a surface property of the polishing pad by the above-mentioned surface property measuring method, and determining whether the polishing pad has reached a replacement time based on a measurement result of the surface property.

In an embodiment, there is provided a polishing method comprising: supporting a new polishing pad by a polishing table; polishing a break-in substrate to perform a break-in process of the new polishing pad; measuring a surface property of the new polishing pad by the above-mentioned surface property measuring method; determining whether the break-in process is completed based on a measurement result of the surface property; and polishing a substrate with use of the new polishing pad when it has been determined that the break-in process is completed.

According to the above-described embodiments, the surface property measuring system includes the cover member disposed between the optical measuring device and the polishing pad. The transparent liquid is supplied onto the polishing pad through the inlet port of the cover member. Since the transparent liquid can be supplied onto the optical path during optical measuring with no contact of the cover member and the polishing pad, adhesion of an impurity to the substrate is prevented, and as a result, a defect in the polishing of the substrate can be prevented. Further, since no time is required for preparation for measuring, the surface property of the polishing pad can be accurately measured in a short time.

Furthermore, according to the above-described embodiments, the transparent liquid is supplied onto the polishing pad through the inlet port provided in the cover member, while the transparent liquid on the polishing pad is sucked through the suction port provided in the cover member. Therefore, when the surface property of the polishing pad is measured during polishing of the substrate with the polishing liquid, the polishing liquid can be prevented from being diluted by the transparent liquid.

DESCRIPTION OF EMBODIMENTS

Embodiments will now be described with reference to the drawings.

Figure 1:
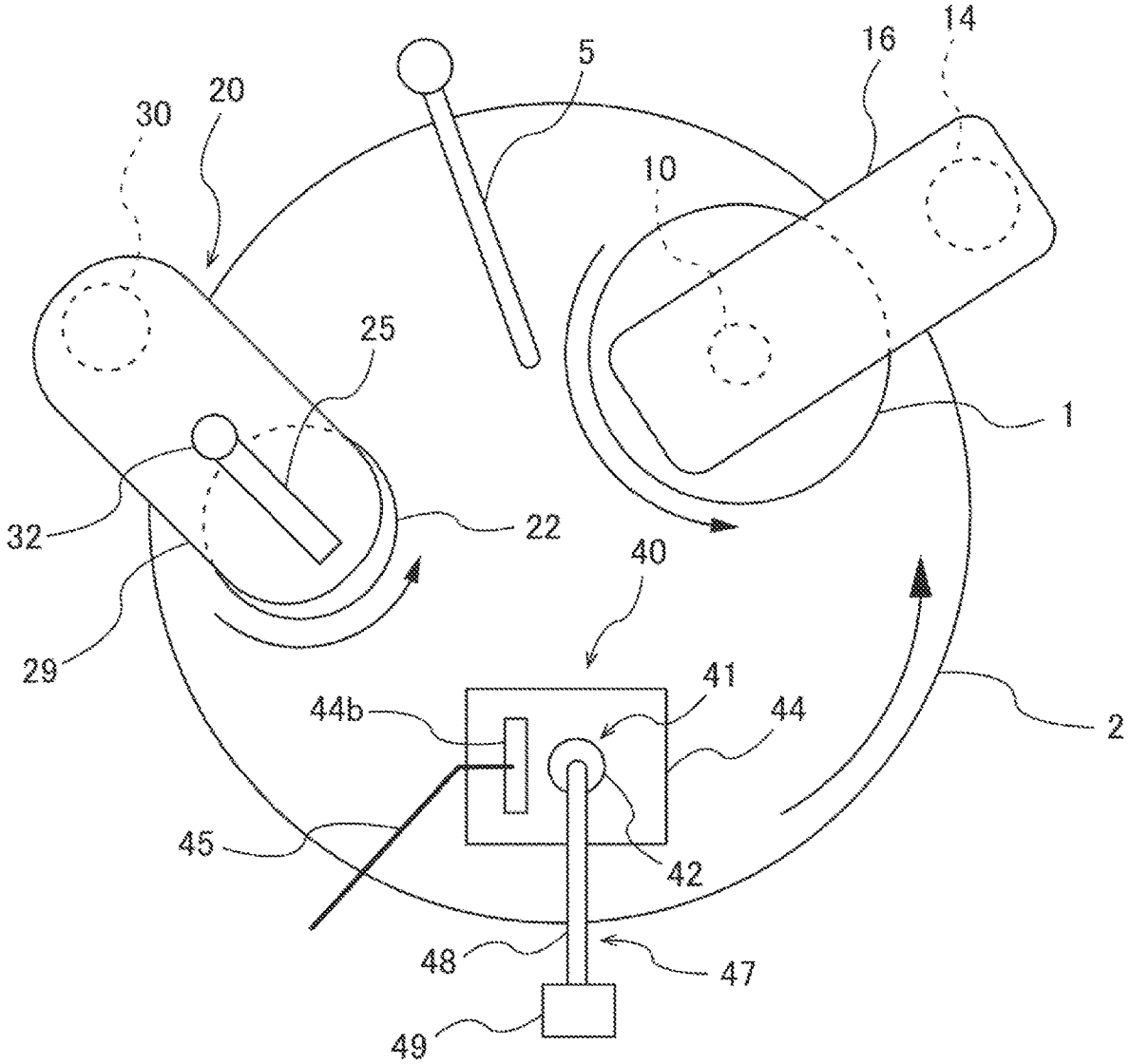
FIG. 1 is a plan view showing an embodiment of a polishing apparatus.
Figure 2:
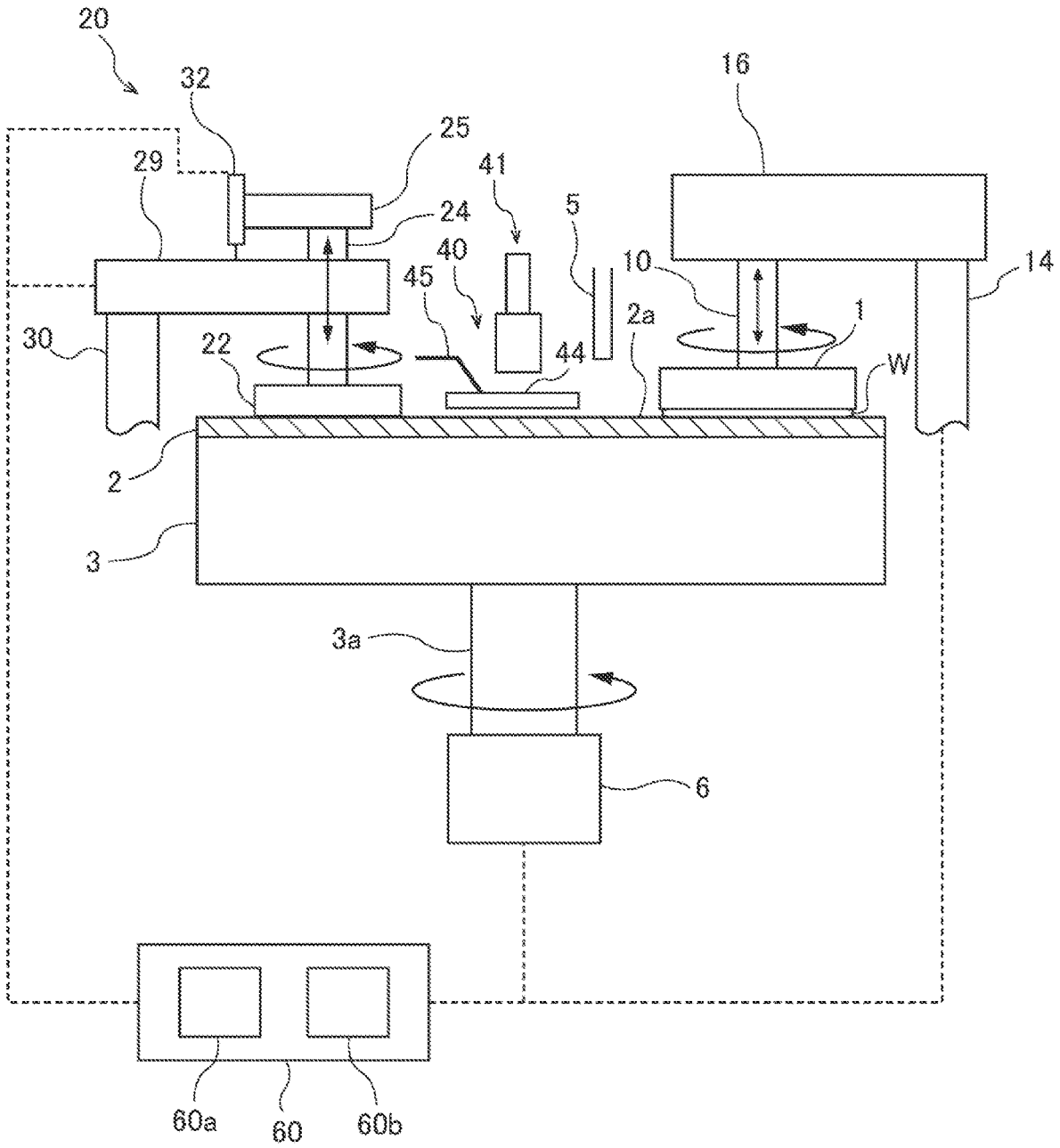
FIG. 2 is a side view of the polishing apparatus shown in FIG. 1.

FIG. 1 is a plan view showing an embodiment of a polishing apparatus. FIG. 2 is a side view of the polishing apparatus shown in FIG. 1. The polishing apparatus 1 is configured to chemically and mechanically polish a substrate W, such as a wafer. As shown in FIGS. 1 and 2, this polishing apparatus includes a polishing table 3 configured to support a polishing pad 2 having a polishing surface 2*a*, a polishing head 1 configured to press the substrate W against the polishing surface 2*a*, a polishing-liquid supply nozzle 5 configured to supply a polishing liquid (e.g., slurry containing abrasive grains) onto the polishing surface 2*a*, and a dresser 20 configured to dress (condition) the polishing surface 2*a* of the polishing pad 2.

The polishing apparatus further includes a polishing-head oscillating shaft 14, a polishing-head oscillating arm 16 coupled to an upper end of the polishing-head oscillating shaft 14, and a polishing-head shaft 10 rotatably supported by a free end of the polishing-head oscillating arm 16. The polishing head 1 is fixed to a lower end of the polishing-head shaft 10. The polishing head 1 is configured to be able to hold the substrate W on its lower surface. The substrate W is held such that a surface to be polished faces downward.

A polishing-head oscillating mechanism (not shown) having an electric motor or the like is disposed in the polishing-head oscillating arm 16. The polishing-head oscillating mechanism is coupled to the polishing-head oscillating shaft 14. This polishing-head oscillating mechanism is configured to oscillate the polishing head 1 and the polishing-head shaft 10 about an axis of the polishing-head oscillating shaft 14 via the polishing-head oscillating arm 16. A polishing-head rotating mechanism (not shown) having an electric motor or the like is further disposed in the polishing-head oscillating arm 16. This polishing-head rotating mechanism is coupled to the polishing-head shaft 10, and is configured to rotate the polishing-head shaft 10 and the polishing head 1 about an axis of the polishing-head shaft 10.

The polishing-head shaft 10 is coupled to a not-shown polishing-head elevating mechanism (including, e.g., a ball screw mechanism or the like). This polishing-head elevating mechanism is configured to vertically move the polishing-head shaft 10 relative to the polishing-head oscillating arm 16. This vertical movement of the polishing-head shaft 10 enables the polishing head 1 to move vertically relative to the polishing-head oscillating arm 16 and the polishing table 3.

The polishing apparatus further includes a table motor 6 configured to rotate the polishing table 3 together with the polishing pad 2. The table motor 6 is disposed below the polishing table 3, and the polishing table 3 is coupled to the table motor 6 via a table shaft 3*a*. The polishing table 3 and the polishing pad 2 are rotated around an axis of the table shaft 3*a* by the table motor 6. The polishing pad 2 is attached to an upper surface of the polishing table 3. An exposed surface of the polishing pad 2 constitutes the polishing surface 2*a* for polishing the substrate W, such as a wafer.

The dresser 20 includes a dressing disk 22 configured to contact the polishing surface 2*a* of the polishing pad 2, a dresser shaft 24 coupled to the dressing disk 22, a support block 25 configured to rotatably support an upper end of the dresser shaft 24, a dresser oscillating arm 29 configured to rotatably support the dresser shaft 24, and a dresser oscillating shaft 30 configured to support the dresser oscillating arm 29. A lower surface of the dressing disk 22 constitutes a dressing surface on which abrasive grains, such as diamond particles, are fixed.

A dresser oscillating mechanism (not shown) having an electric motor or the like is disposed in the dresser oscillating arm 29. The dresser oscillating mechanism is coupled to the dresser oscillating shaft 30. This dresser oscillating mechanism is configured to oscillate the dressing disk 22 and the dresser shaft 24 around an axis of the dresser oscillating shaft 30 via the dresser oscillating arm 29.

The dresser shaft 24 is coupled to a not-shown disk pressing mechanism (including. e.g., an air cylinder) disposed in the dresser oscillating arm 29. This disk pressing mechanism is configured to press the lower surface of the dressing disk 22, which constitutes the dressing surface, against the polishing surface 2*a* of the polishing pad 2 via the dresser shaft 24. The dresser shaft 24 and the dressing disk 22 can vertically move relative to the dresser oscillating arm 29. The dresser shaft 24 is coupled to a not-shown disk rotating mechanism (including, e.g., an electric motor) disposed in the dresser oscillating arm 29. This disk rotating mechanism is configured to rotate the dressing disk 22 via the dresser shaft 24 about an axis of the dresser shaft 24.

The dresser 20 includes a pad-height measuring device 32 configured to measure a height of the polishing surface 2*a*. The pad-height measuring device 32 employed in this embodiment is a contact displacement sensor. The pad-height measuring device 32 is fixed to the support block 25, and a contact element of the pad-height measuring device 32 is in contact with the dresser oscillating arm 29. Since the support block 25 can vertically move together with the dresser shaft 24 and the dressing disk 22, the pad-height measuring device 32 can vertically move together with the dresser shaft 24 and the dressing disk 22. On the other hand, a position in a vertical direction of the dresser oscillating arm 29 is fixed. The pad-height measuring device 32 vertically moves together with the dresser shaft 24 and the dressing disk 22 while the contact element of the pad-height measuring device 32 is in contact with the dresser oscillating arm 29. Therefore, the pad-height measuring device 32 can measure a displacement of the dressing disk 22 with respect to the dresser oscillating arm 29.

The pad-height measuring device 32 can measure the height of the polishing surface 2*a* via the dressing disk 22. Specifically, with the pad-height measuring device 32 being coupled to the dressing disk 22 via the dresser shaft 24, the pad-height measuring device 32 can measure the height of the polishing surface 2*a* during dressing of the polishing pad 2. The height of the polishing surface 2*a* is a distance from a preset reference plane to the lower surface of the dressing disk 22. The reference plane is an imaginary plane. For example, if the reference plane is the upper surface of the polishing table 3, the height of the polishing surface 2*a* corresponds to a thickness of the polishing pad 2.

In this embodiment, the pad-height measuring device 32 is a linear-scale type sensor, while in one embodiment, the pad-height measuring device 32 may be a non-contact type sensor, such as a laser type sensor, an ultrasonic sensor, or an eddy current sensor. Further, in one embodiment, the pad-height measuring device 32 may be fixed to the dresser oscillating arm 29 and arranged to measure a displacement of the support block 25. In this case, the pad-height measuring device 32 can also measure the displacement of the dressing disk 22 with respect to the dresser oscillating arm 29.

In the embodiment described above, the pad-height measuring device 32 is configured to indirectly measure the height of the polishing surface 2*a* based on a position of the dressing disk 22 which is in contact with the polishing surface 2*a*, while the configuration of the pad-height measuring device 32 is not limited to this embodiment as long as the pad-height measuring device 32 can accurately measure the height of the polishing surface 2*a*. In one embodiment, the pad-height measuring device 32 may be a non-contact sensor, such as a laser-type sensor or an ultrasonic sensor, which is arranged above the polishing pad 2 and is configured to directly measure the height of the polishing surface 2*a*.

The polishing apparatus includes a polishing controller 60, and the pad-height measuring device 32 is coupled to the polishing controller 60. An output signal (i.e., a measured value of the height of the polishing surface 2*a*) of the pad-height measuring device 32 is transmitted to the polishing controller 60.

The polishing head 1, the polishing-liquid supply nozzle 5, the table motor 6, and the dresser 20 of the polishing apparatus are electrically connected to the polishing controller 60, and operations of the polishing head 1, the polishing-liquid supply nozzle 5, the table motor 6, and the dresser 20 are controlled by the polishing controller 60.

The polishing controller 60 is composed of at least one computer. The polishing controller 60 includes a memory 60*a* storing programs therein for controlling the operations of the polishing apparatus, and a processer 60*b* configured to perform arithmetic operations according to instructions contained in the programs. The memory 60*a* includes a main memory, such as a random access memory (RAM), and an auxiliary memory, such as a hard disk drive (HDD) or a solid state drive (SSD). Examples of the processer 60*b* include a central processing unit (CPU) and a graphics processing unit (GPU). However, the specific configuration of the polishing controller 60 is not limited to these examples.

Polishing of the substrate W is performed as follows. The polishing-liquid supply nozzle 5 supplies the polishing liquid onto the polishing surface 2*a* of the polishing pad 2 on the polishing table 3, while the polishing table 3 and the polishing head 1 are rotated in directions indicated by the arrows in FIGS. 1 and 2. The dressing disk 22 is arranged outside the polishing pad 2. While the substrate W is rotated by the polishing head 1, the substrate W is pressed by the polishing head 1 against the polishing surface 2*a* of the polishing pad 2 in the presence of the polishing liquid on the polishing pad 2. The surface of the substrate W is polished by a chemical action of the polishing liquid and mechanical actions of the abrasive grains contained in the polishing liquid and/or the polishing pad 2. Water-polishing of the substrate W may then be performed by supplying pure water onto the polishing pad 2 from a not-shown pure-water nozzle.

After the polishing of the substrate W is terminated, the substrate W is moved to a position outside the polishing pad 2, and is transferred to an apparatus which performs a next process. Dressing of the polishing surface 2*a* of the polishing pad 2 by the dresser 20 is then performed. Specifically, pure water is supplied onto the polishing surface 2*a* from a not-shown pure-water nozzle, while the polishing pad 2 and polishing table 3 are rotated. The dressing disk 22 is placed on the polishing pad 2 and rubs against the polishing surface 2*a* of the polishing pad 2 while the dressing disk 22 is rotating. The dressing disk 22 dresses (conditions) the polishing surface 2*a* by slightly scraping away the polishing pad 2. The dressing of the polishing pad 2 by the dresser 20 may be performed each time one substrate W is polished, or may be performed each time a predetermined number of substrates W are polished.

Foamed polyurethane having a large number of minute holes (pores) in the polishing surface 2*a* is generally used for the polishing pad 2. Further, the polishing surface 2*a* of the polishing pad 2 has holes, which are also referred perforations, and pad grooves with patterns, such as lattice patterns, spiral patterns, or concentric circle patterns. As the polishing of substrate W or the dressing is repeated, the polishing surface 2*a* of the polishing pad 2 is gradually worn and polishing debris or the like clogs the holes and the pad grooves formed in the polishing surface 2*a*. Such a change in a surface property of the polishing pad 2 can cause deterioration of the polishing performance of the polishing pad, and as a result, a polishing rate of a substrate decreases. Therefore, it is necessary to accurately measure the surface property of the polishing pad 2 in order to determine an appropriate replacement time of the polishing pad 2. Thus, the polishing apparatus of this embodiment further includes a surface property measuring system 40 configured to measure the surface property of the polishing pad 2. In this specification, the holes and the pad grooves formed in the polishing pad 2 are collectively referred to as "recesses".

As shown in FIGS. 1 and 2, the surface property measuring system 40 includes an optical measuring device 41 configured to measure the surface property of the polishing surface 2*a* of the polishing pad 2, a cover member 44 facing the polishing surface 2*a* of the polishing pad 2, and a transparent-liquid supply line 45 configured to supply a transparent liquid onto the polishing pad 2. The optical measuring device 41 is disposed above the polishing pad 2. The cover member 44 is disposed between the polishing pad 2 and the optical measuring device 41. The cover member 44 is smaller than the polishing pad 2, and is arranged so as to cover a part of the polishing pad 2. The surface property measuring system 40 is disposed so as not to be in contact with the polishing head 1 and the dresser 20. Therefore, the surface property measuring system 40 can measure the surface property of the polishing pad 2 during polishing of the substrate W performed by the polishing head 1 or during dressing of the polishing pad 2 performed by the dresser 20.

Figure 3:
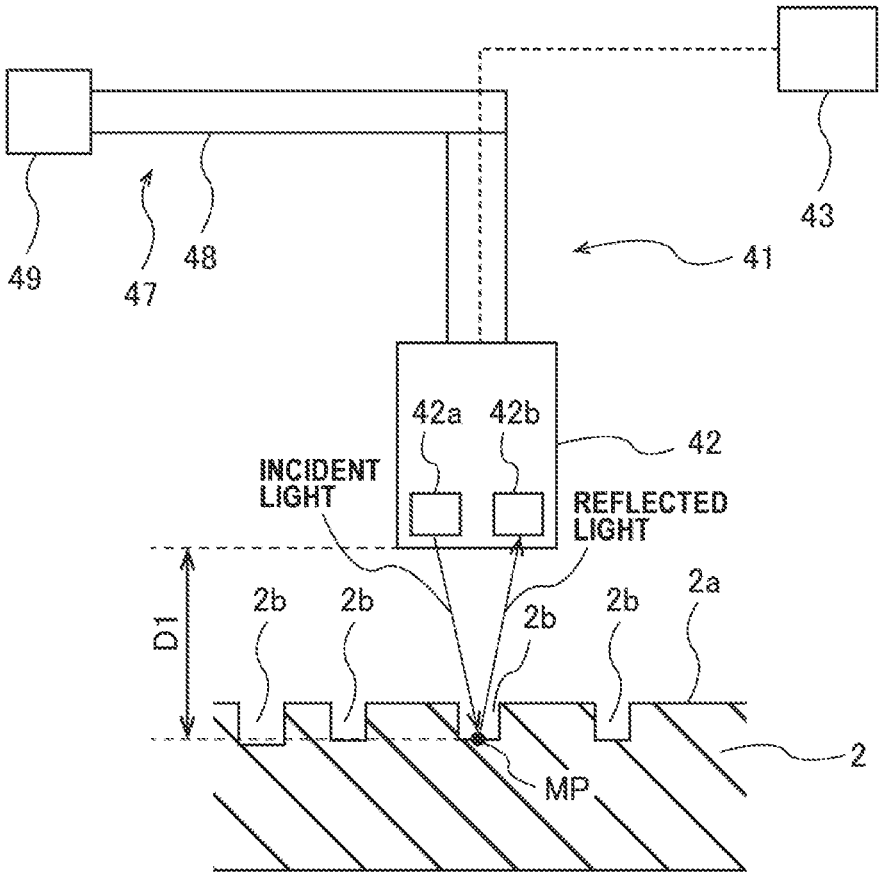
FIG. 3 is a diagram illustrating an optical measuring device when measuring a polishing surface of a polishing pad.

FIG. 3 is a diagram illustrating the optical measuring device 41 when measuring the polishing surface 2*a* of the polishing pad 2. In FIG. 3, for the purpose of descriptions, depiction of the cover member 44 and the transparent-liquid supply line 45 is omitted. The optical measuring device 41 includes a measuring head 42, and a data processer 43. The measuring head 42 of this embodiment is a laser displacement meter configured to measure a distance from a preset reference plane to a target object. The measuring head 42 includes a light source 42*a* configured to emit a laser beam, and a light receiving element 42*b* configured to receive reflected light from the target object. The reference plane is an imaginary plane, which may be, for example, a plane including a lower end of the measuring head 42.

The measuring head 42 is configured to measure a distance D1 to the polishing surface 2*a* of the polishing pad 2. The measuring head 42 is disposed above the polishing surface 2*a* of the polishing pad 2, and the lower end of the measuring head 42 is oriented toward the polishing surface 2*a* of the polishing pad 2. In this embodiment, the reference plane is set to a plane including the lower end of the measuring head 42. Therefore, the distance D1 is a distance from the lower end of the measuring head 42 to a measurement point MP on the polishing surface 2*a*. The measuring head 42 directs the light (laser light) from the light source 42*a* to the polishing surface 2*a* of the polishing pad 2*a*, and receives the reflected light from the polishing surface 2*a* by the light receiving element 42*b*. The measuring head 42 measures the distance D1 to the measurement point MP on the polishing pad 2 based on the reflected light.

Figure 4:
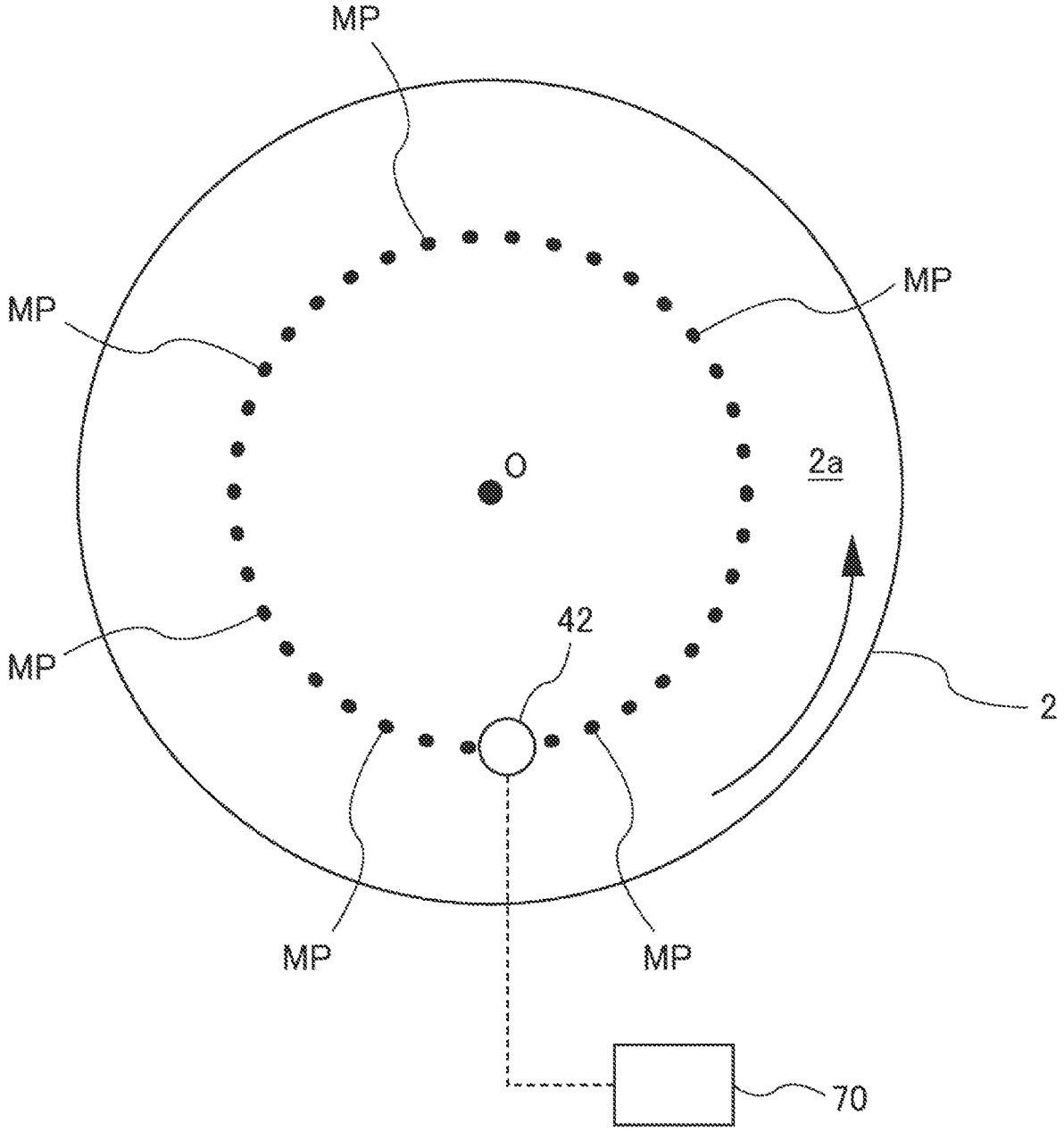
FIG. 4 is a diagram showing a plurality of measurement points on the polishing surface of the polishing pad.

FIG. 4 is a diagram showing a plurality of measurement points MP on the polishing surface 2*a* of the polishing pad 2. The measuring head 42 directs the light to the polishing surface 2*a* of the rotating polishing pad 2 at predetermined time intervals (e.g., every 5 milliseconds), and measures the distance D1 to the polishing surface 2*a* of the polishing pad 2 based on the reflected light from the polishing surface 2*a*. The measuring head 42 is coupled to an operation controller 70 configured to control operations of the surface property measuring system 40 described below. The operation controller 70 is configured to instruct the measuring head 42 to direct the light to the polishing surface 2*a* of the polishing pad 2. As shown in FIG. 4, the plurality of measurement points MP are located at equal intervals on a circumference of a circle centered at a rotation center O of the polishing pad 2. The measuring head 42 measures the distance D1 to the polishing surface 2*a* at the plurality of measurement points MP continuously for a predetermined period of time. In one embodiment, a plurality of measured values of the distance D1 at each one of the plurality of measurement points MP may be obtained in one continuous measuring operation. One continuous measuring operation may be performed each time one substrate W is polished, or may be performed each time a predetermined number of substrates W are polished.

Figure 5:
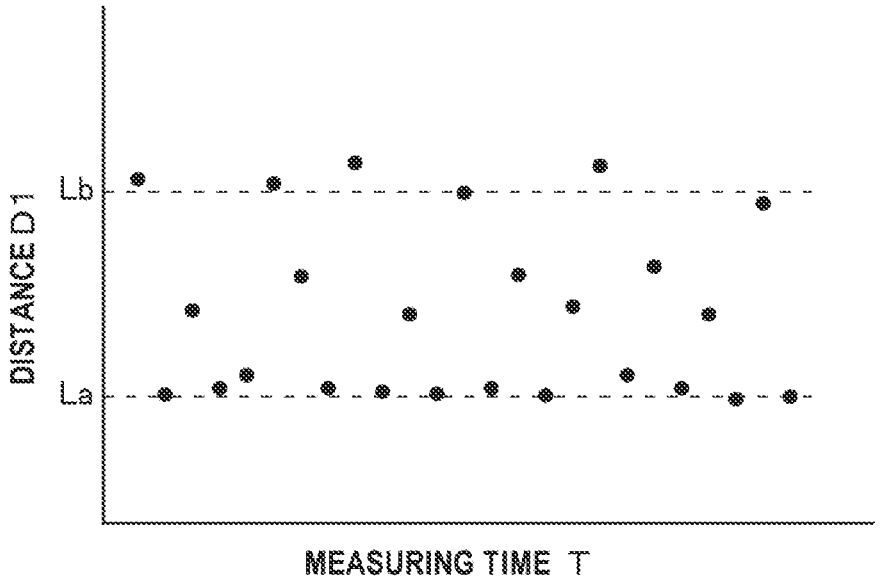
FIG. 5 is a graph showing a relationship between distance measured at the plurality of measurement points and measuring time.
Figure 6A:
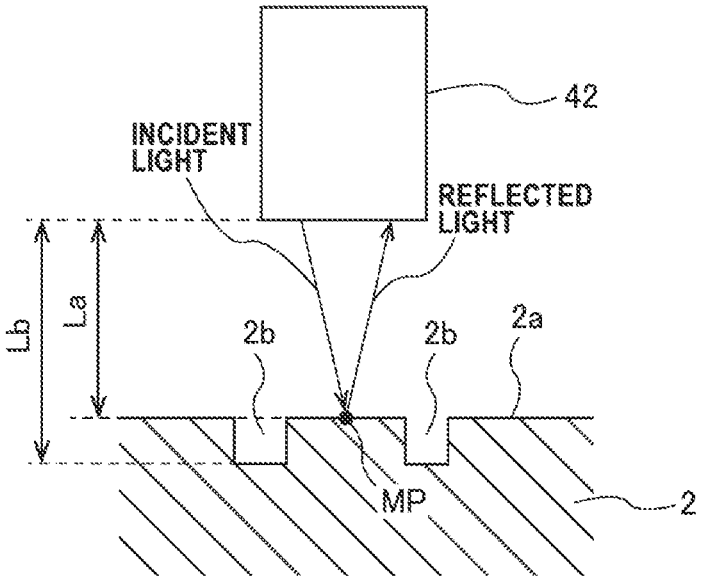
FIG. 6A is a diagram illustrating the optical measuring device when measuring a flat portion of the polishing surface where no recess is formed.
Figure 6B:
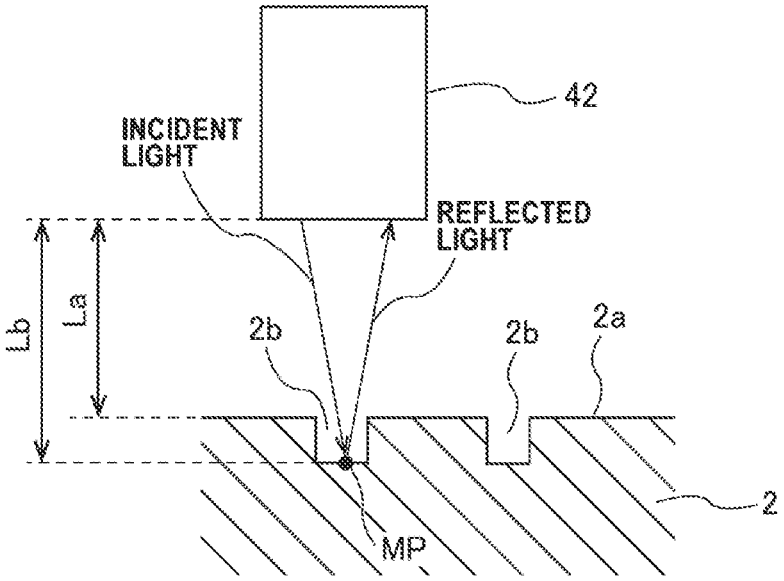
FIG. 6B is a diagram illustrating the optical measuring device when measuring a bottom portion of a recess which is formed in the polishing surface.

FIG. 5 is a graph showing a relationship between the distance D1 measured at the plurality of measurement points and measuring time T. In FIG. 5, vertical axis represents the distance D1, and horizontal axis represents the measuring time T. The graph shown in FIG. 5 has been obtained by rotating the polishing pad 2 and measuring the plurality of measurement points MP on the polishing surface 2*a* by the measuring head 42 in one continuous measuring operation. The polishing pad 2 used in this measuring is in an initial condition of use with no wear. Measured values representing the distance D1 close to a value La are measured values obtained when the measuring head 42 measures the distance D1 to a flat portion where a recess 2*b* is not formed in the polishing surface 2*a*, as shown in FIG. 6A. Measured values representing the distance D1 close to a value Lb are measured values obtained when the measuring head 42 measures the distance D1 to a bottom of the recess 2*b* formed in the polishing surface 2*a*, as shown in FIG. 6B.

Figure 7A:
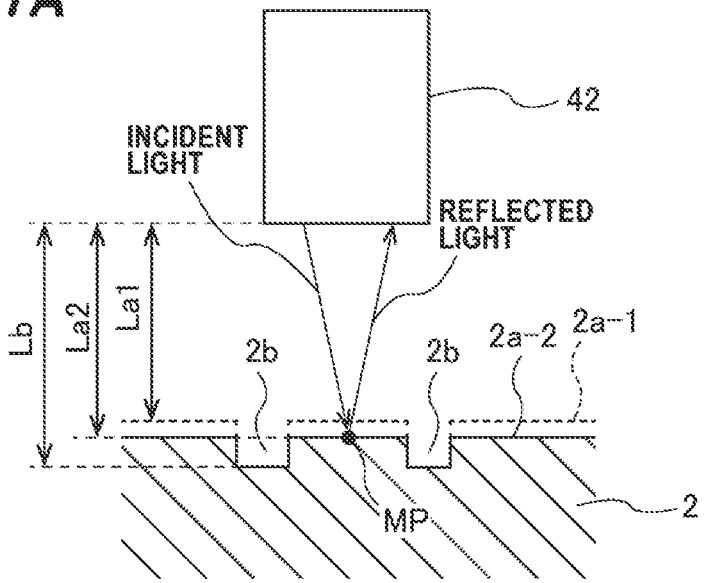
FIG. 7A is a diagram illustrating the optical measuring device when measuring the polishing surface which has been worn.

As shown in FIG. 7A, as the polishing of the substrate W or the dressing of the polishing pad 2 is repeated, the polishing pad 2 is worn from a polishing surface 2*a*-1 before wear to a polishing surface 2*a*-2. A relationship between a measured value La1 of the distance D1 before wear and a measured value La2 of the distance D1 after wear is La1<La2. In other words, the value of the distance D1 corresponding to the measured value La shown in FIG. 5 becomes larger as the polishing pad 2 is worn.

Figure 7B:
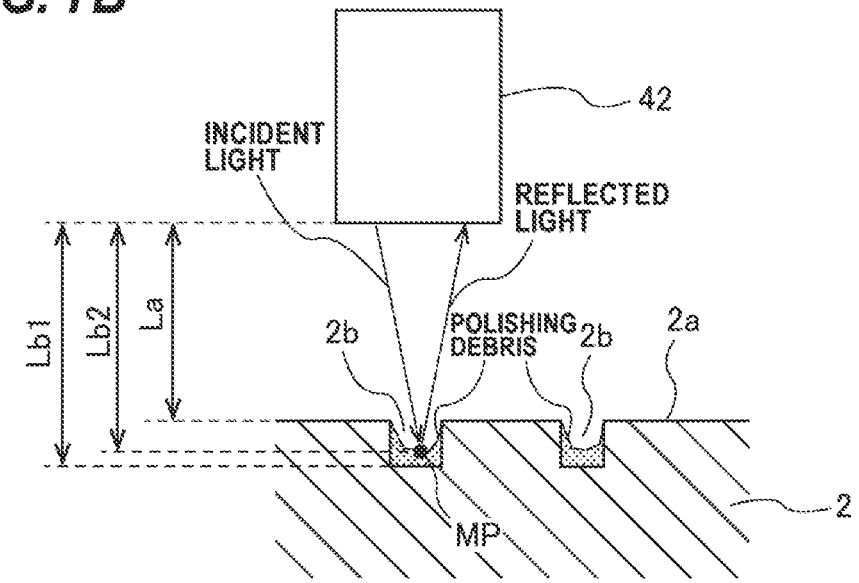
FIG. 7B is a diagram illustrating the optical measuring device when measuring the polishing surface when polishing debris clogs recesses.

As shown in FIG. 7B, as the polishing of the substrate W or the dressing of the polishing pad 2 is repeated, the polishing debris or the like clogs the recess 2*b* formed in the polishing surface 2*a* of the polishing pad 2. When the measuring head 42 measures the recess 2*b* clogged with the polishing debris, the light from the measuring head 42 is reflected by a surface of the polishing debris in the recess 2*b*. A relationship between a measured value Lb1 of the distance D1 to the bottom of the recess 2*b* before clogged with the polishing debris and a measured value Lb2 of the distance D1 to the surface of the polishing debris clogging the recess 2*b* is Lb1>Lb2. In other words, as the polishing debris or the like clogs the recess 2*b* of the polishing pad 2, the value of the distance D1 corresponding to the measured value Lb shown in FIG. 5 becomes smaller.

Figure 8:
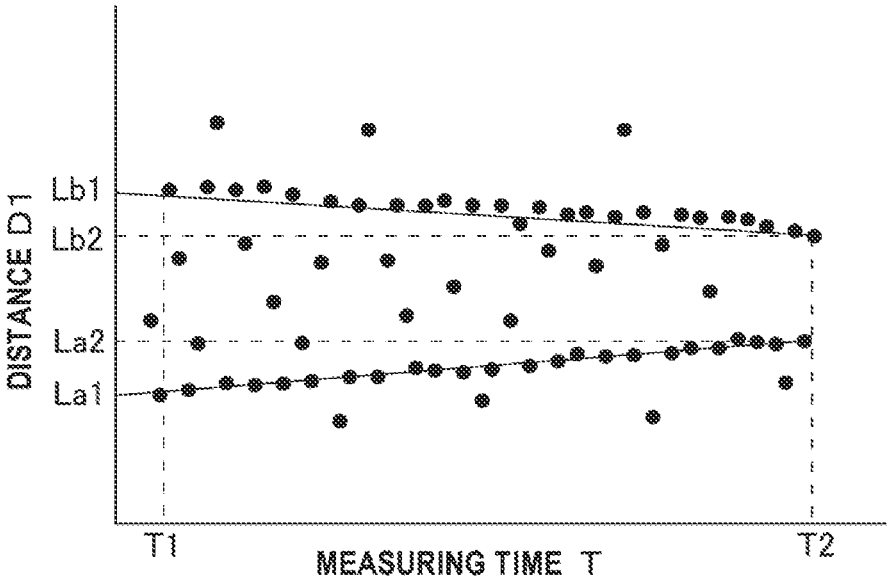
FIG. 8 is a graph showing a relationship between the distance which changes as the polishing pad is used over time and the measuring time.

FIG. 8 is a graph showing a relationship between the distance D1 which changes as the polishing pad 2 is used over time and the measuring time T. FIG. 8 is a graph plotting a relationship between measured values of the distance D1 obtained from a plurality of continuous measuring operations that have been conducted from the beginning to the end of use of the polishing pad 2 and the measuring time T. FIG. 8 may be a graph plotting a relationship between an average value of the measured values La and Lb obtained in one continuous measuring operation and the measuring time T. In FIG. 8, vertical axis represents the distance D1, and horizontal axis represents the measuring time T. As described with reference to FIG. 7A, the flat portion of the polishing pad 2 wears as the polishing pad 2 is used over time. As shown in FIG. 8, the measured value of the distance D1 becomes larger from the measured value La1 when the polishing pad 2 has not been worn (time T1) to the measured value La2 when the polishing pad 2 has been worn (time T2). Therefore, degree of wear of the polishing pad 2 can be estimated from the change in the measured value of the distance D1.

As described with reference to FIG. 7B, the polishing debris or the like clogs the recess 2*b* of the polishing pad 2 as the polishing pad 2 is used over time. As shown in FIG. 8, the measured value of the distance D1 becomes smaller from the measured value Lb1 when the recess 2*b* of the polishing pad 2 has not been clogged (time T1) to the measured value Lb2 when the recess 2*b* of the polishing pad 2 has been clogged (time T2). Therefore, degree of clogging of the recess 2*b* of the polishing pad 2 can be estimated from the change in the measured value of the distance D1.

The measuring head 42 is coupled to the data processer 43. The data processer 43 is composed of at least one computer. The measured value of the distance D1 obtained by the measuring head 42 is transmitted to the data processer 43. The data processer 43 measures the surface property of the polishing pad 2 by performing data processing on the relationship between the distance D1 and the measuring time T as shown in FIGS. 5 and 8, based on the measured values of the distance D1 transmitted from the measuring head 42.

In this manner, the optical measuring device 41 can measure the surface property of the polishing pad 2. The measuring of the surface property of the polishing pad 2 includes estimating the degree of wear of the polishing pad 2 and/or estimating the degree of clogging of the recesses 2*b* of the polishing pad 2. In one embodiment, the measuring of the surface property of the polishing pad 2 includes measuring a surface roughness of the polishing surface 2*a* of the polishing pad 2. The measurement result of the surface property of the polishing pad 2 is transmitted to the operation controller 70 coupled to the data processer 43. The operation controller 70 determines a replacement time of the polishing pad 2, as described later.

As shown in FIG. 1, the surface property measuring system 40 may further include a measuring-head moving mechanism 47 coupled to the measuring head 42. The measuring-head moving mechanism 47 is configured to be able to move the measuring head 42 in radial direction of the polishing table 3 and the polishing pad 2. The measuring-head moving mechanism 47 is coupled to the operation controller 70 which will be described later, and operations of the measuring-head moving mechanism 47 are controlled by the operation controller 70.

In one embodiment, the measuring head 42 may be moved in the radial direction by the measuring-head moving mechanism 47 during the measuring of the surface property of the polishing pad 2. The measuring-head moving mechanism 47 includes a measuring-head arm 48 supporting the measuring head 42, and an actuator 49 coupled to the measuring-head arm 48. The actuator 49 is disposed outside the polishing table 3. The actuator 49 may be constituted of a combination of a motor and a torque transmission mechanism (e.g., including gears).

The measuring of the surface property of the polishing pad 2 is performed during the polishing of the substrate W using the polishing liquid or the pure water, during the dressing of the polishing pad 2, after the dressing of the polishing pad 2 until polishing of a next substrate W is started, during a break-in process of the polishing pad 2 using a break-in substrate, after the break-in process, etc. During the measuring, presence of the polishing liquid or the polishing debris in the optical path of the light emitted from the measuring head 42 and the reflected light from the polishing surface 2*a* may cause a failure in accurate measuring of the surface property of the polishing pad 2. Thus, the surface property measuring system 40 of this embodiment provides a transparent liquid filling a space between the cover member 44 and the polishing surface 2*a* of the polishing pad 2 to remove the polishing liquid or the polishing debris, etc. from the optical path during the measuring, so that the surface property measuring system 40 can accurately measure the surface property.

Figure 9:
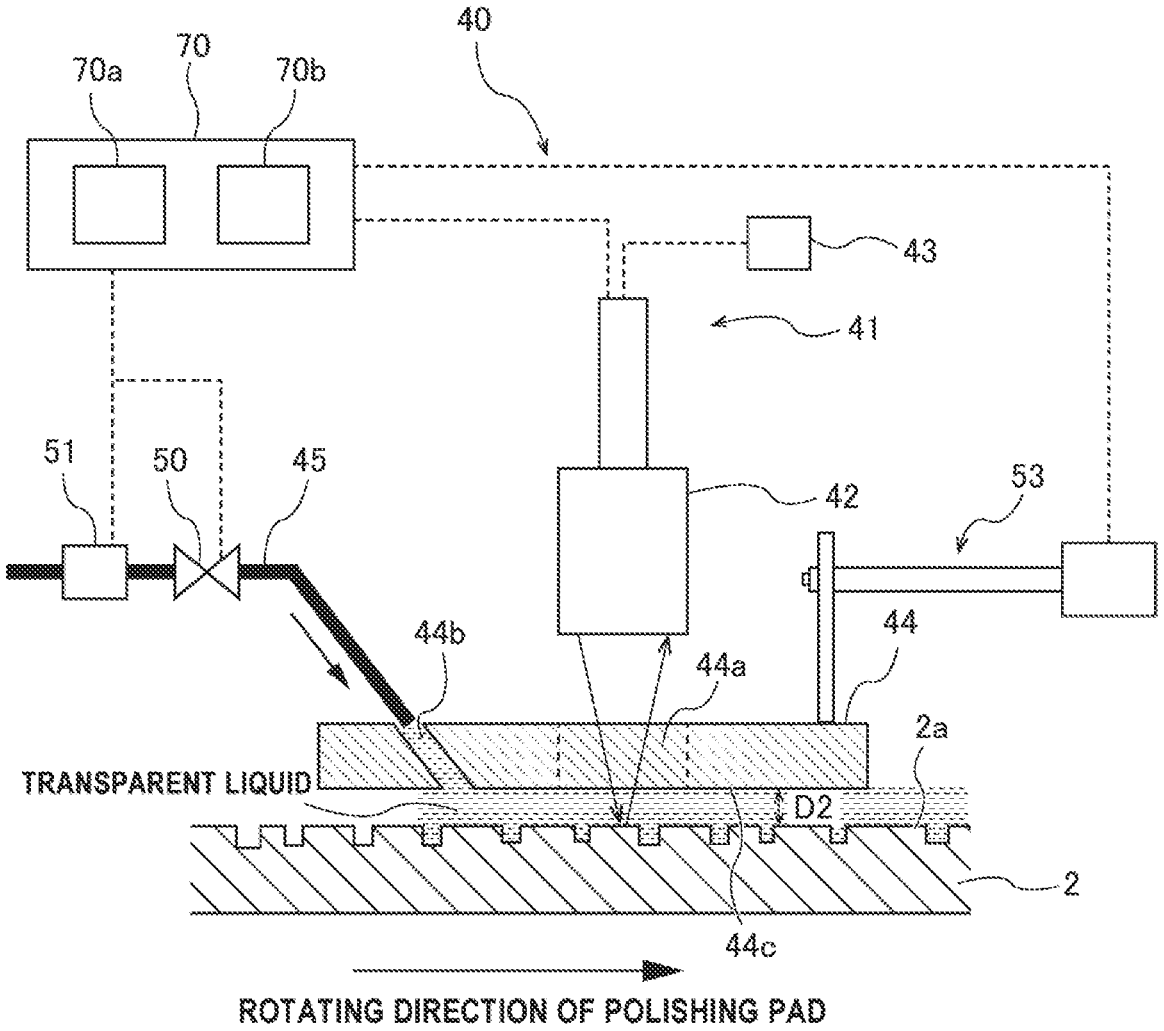
FIG. 9 is a schematic diagram showing an embodiment of a surface property measuring system.

FIG. 9 is a schematic diagram showing an embodiment of the surface property measuring system 40. The cover member 44 is disposed between the polishing pad 2 and the optical measuring device 41 (measuring head 42). The cover member 44 has a facing surface 44*c* parallel to the polishing surface 2*a* of the polishing pad 2. The cover member 44 is located away from the polishing surface 2*a* of the polishing pad 2 (i.e., the cover member 44 is in non-contact with the polishing surface 2*a*). The cover member 44 has a light transmissive portion 44*a* on the optical path of the light emitted from the measuring head 42 and the reflected light from the polishing surface 2*a*. The light transmissive portion 44*a* is a portion through which the light emitted from the measuring head 42 and the reflected light from the polishing surface 2*a* pass. The light transmissive portion 44*a* is depicted with dashed line shown in FIG. 9. The light transmissive portion 44*a* is made of a transparent material through which the light emitted from the measuring head 42 and the reflected light from the polishing surface 2*a* can pass. In this embodiment, the cover member 44 is a transparent plate, and the entire cover member 44 including the light transmissive portion 44*a* is made of a transparent material.

In one embodiment, the cover member 44 may be such that the light transmissive portion 44*a* is made of a transparent material and portion other than the light transmissive portion 44*a* is made of an opaque material. Examples of the material for the light transmissive portion 44*a* include quartz glass, acrylic resin, polycarbonate resin, polyvinyl chloride resin, and the like. The optical measuring device 41 directs the light to the polishing surface 2*a* of the polishing pad 2 through the light transmissive portion 44*a* of the cover member 44, receives the reflected light from the polishing surface 2*a* through the light transmissive portion 44*a*, and measures the surface property of the polishing pad 2 based on the reflected light.

The cover member 44 has an inlet port 44*b* located upstream of the light transmissive portion 44*a* in a rotating direction of the polishing pad 2. In other words, the inlet port 44*b* is located upstream of the optical path of the light emitted from the measuring head 42 and the reflected light from the polishing surface 2*a*. In this embodiment, the inlet port 44*b* is located upstream of the measuring head 42 of the optical measuring device 41.

The inlet port 44*b* extends through the cover member 44 from its top to bottom, and slopes downwardly toward the inside of the cover member 44. In one embodiment, the inlet port 44*b* may extend through the cover member 44 in a direction perpendicular to the facing surface 44*c* of the cover member 44 without sloping. As shown in FIG. 1, the inlet port 44*b* is a slit having a rectangular shape when viewed from above. The inlet port 44*b* is not limited to this embodiment, and may be an opening having a circular shape or an oval shape when viewed from above.

The transparent-liquid supply line 45 is coupled to the inlet port 44*b* of the cover member 44, and is configured to supply a transparent liquid onto the polishing pad 2 through the inlet port 44*b*. As shown in FIG. 9, the entire cover member 44 is located away from the polishing surface 2*a* of the polishing pad 2. A gap is formed between the facing surface 44*c* of the cover member 44 and the polishing surface 2*a* of the polishing pad 2, so that the transparent liquid flows through this gap. The transparent liquid supplied from the transparent-liquid supply line 45 flows through the gap between the cover member 44 and the polishing surface 2*a* of the polishing pad 2 along the rotating direction of the polishing pad 2.

The gap between the facing surface 44*c* of the cover member 44 and the polishing surface 2*a* of the polishing pad 2 is filled with a flow of the transparent liquid. In particular, the entire gap between the light transmissive portion 44*a* and the polishing surface 2*a* of the polishing pad 2 is filled with a flow of the transparent liquid. Such a configuration enables stable measuring, because bubbles or gas layers (or gas-liquid interface), which may be a disturbance in optical measuring by the optical measuring device 41, is not present in the measuring optical path. In addition, since the inlet port 44*b* is located directly above the gap between the facing surface 44*c* of the cover member 44 and the polishing surface 2*a* of the polishing pad 2, the transparent liquid can be smoothly supplied into the gap. No turbulence is generated in the flow of the transparent liquid when the transparent liquid flows into the gap, so that the generation of bubbles can be prevented. The transparent liquid is, for example, pure water. The transparent liquid may be any transparent liquid, for example, KOH solution used for the polishing liquid.

The surface property measuring system 40 further includes a supply flow-rate regulating valve 50 configured to be able to regulate a flow rate of the transparent liquid supplied from the transparent-liquid supply line 45 to the inlet port 44*b*, and a flow meter 51 configured to measure the flow rate of the transparent liquid flowing through the transparent-liquid supply line 45. The supply flow-rate regulating valve 50 and the flow meter 51 are attached to the transparent-liquid supply line 45.

The surface property measuring system 40 includes the operation controller 70 configured to control the operations of the surface property measuring system 40. The supply flow-rate regulating valve 50 is electrically connected to the operation controller 70, and operations of the supply flow-rate regulating valve 50 are controlled by the operation controller 70. In one embodiment, the supply flow-rate regulating valve 50 may be manually operable.

The flow rate of the transparent liquid supplied from the transparent-liquid supply line 45 to the inlet port 44*b* is determined based on parameters, such as a rotating speed of the polishing table 3, a distance from the polishing surface 2*a* to the facing surface 44*c* of the cover member 44, a type of polishing pad 2 (a material of the polishing pad 2, a shape of the recess formed in the polishing surface 2*a*, etc.), and a type of the polishing liquid.

The flow rate of the transparent liquid supplied from the transparent-liquid supply line 45 to the inlet port 44*b* is such that the transparent liquid sufficiently fills the gap between the facing surface 44*c* of the cover member 44 and the polishing surface 2*a* of the polishing pad 2. If the flow rate of the transparent liquid supplied from the transparent-liquid supply line 45 is too low, the gap between the cover member 44 and the polishing surface 2*a* of the polishing pad 2 is not sufficiently filled with the transparent liquid, and bubbles may be generated. If the flow rate of the transparent liquid is too high, a rapid flow of the transparent liquid is formed in the gap between the cover member 44 and the polishing surface 2*a* of the polishing pad 2, and turbulence may be generated.

In one embodiment, supply flow-rate data indicating a relationship between the parameters (e.g., the rotating speed of the polishing table 3, the distance from the polishing surface 2*a* to the facing surface 44*c* of the cover member 44, the type of the polishing pad 2, and the type of the polishing liquid) and an optimal flow rate of the transparent liquid to be supplied from the transparent-liquid supply line 45 may be obtained in advance, and the supply flow-rate data may be stored in the operation controller 70. The operation controller 70 is coupled to the polishing controller 60 configured to control the operations of the polishing apparatus. The operation controller 70 may control operations of the supply flow-rate regulating valve 50 based on each parameter obtained from the polishing controller 60 and the supply flow-rate data.

For example, the operation controller 70 obtains the measured value of the height of the polishing surface 2*a* of the polishing pad 2 obtained by the pad-height measuring device 32 from the polishing controller 60, and determines the flow rate of the transparent liquid based on the obtained measured value of the height of the polishing surface 2*a* and the supply flow-rate data. The operation controller 70 may control the operations of the supply flow-rate regulating valve 50 so as to supply the transparent liquid at an optimum flow rate. Alternatively, the operation controller 70 may determine the flow rate of the transparent liquid based on the distance D1 to the polishing surface 2*a* of the polishing pad 2 measured by the measuring head 42 of the optical measuring device 41 to thereby control the operations of the supply flow-rate regulating valve 50.

In another embodiment, the operation controller 70 may calculate a standard deviation of the measured value of the surface property obtained by the optical measuring device 41. If the standard deviation is larger than a predetermined threshold value (i.e., if a degree of variation is large), the operation controller 70 may control the operations of the supply flow-rate regulating valve 50 so as to increase the flow rate of the transparent liquid supplied from the transparent-liquid supply line 45. Alternatively, if the measured value of the surface property obtained by the optical measuring device 41 is smaller than a predetermined threshold value, the operation controller 70 may control the operations of the supply flow-rate regulating valve 50 so as to increase the flow rate of the transparent liquid supplied from the transparent-liquid supply line 45.

As shown in FIG. 9, the surface property measuring system 40 may further include a cover-member height adjusting mechanism 53 configured to adjust a height of the cover member 44. The cover-member height adjusting mechanism 53 is coupled to the cover member 44. The cover-member height adjusting mechanism 53 may be constituted of, for example, a combination of a servo motor and a ball screw mechanism. The cover-member height adjusting mechanism 53 is electrically connected to the operation controller 70. The operation controller 70 may obtain the measured value of the height of the polishing surface 2*a* of the polishing pad 2 obtained by the pad-height measuring device 32 from the polishing controller 60, and may instruct the cover-member height adjusting mechanism 53 to adjust the height of the cover member 44 with respect to the polishing surface 2*a* of the polishing pad 2 based on the measured value of the height of the polishing surface 2*a*.

The height of the cover member 44 is, in other words, a distance from the polishing surface 2*a* of the polishing pad 2 to the facing surface 44*c* of the cover member 44. In one embodiment, a distance D2 from the polishing surface 2*a* of the polishing pad 2 to the facing surface 44*c* of the cover member 44 is 5 mm or less. If the distance D2 from the polishing surface 2*a* of the polishing pad 2 to the facing surface 44*c* of the cover member 44 is too small, the transparent liquid may be difficult to flow into the gap between the cover member 44 and the polishing surface 2*a* of the polishing pad 2, and as a result, the polishing liquid or the polishing debris present in the optical path during the measuring cannot be removed by the flow of the transparent liquid. In addition, the cover member 44 may contact the polishing surface 2*a* of the polishing pad 2, thus causing a damage to the polishing pad 2. If the distance D2 from the polishing surface 2*a* of the polishing pad 2 to the facing surface 44*c* of the cover member 44 is too large, the transparent liquid may be likely to flow out of the cover member 44, and the transparent liquid may be difficult to sufficiently fill the gap between the cover member 44 and the polishing surface 2*a* of the polishing pad 2.

The operation controller 70 is composed of at least one computer. The operation controller 70 includes a memory 70*a* storing programs therein for controlling the operations of the surface property measuring system 40, and a processer 70*b* configured to perform arithmetic operations according to instructions contained in the programs. The memory 70*a* includes a main memory, such as a random access memory (RAM), and an auxiliary memory, such as a hard disk drive (HDD) or a solid state drive (SSD). Examples of the processer 70*b* include a central processer (CPU) and a graphics processer (GPU). However, the specific configuration of the operation controller 70 is not limited to these examples.

In one embodiment, the above-described data processer 43 may be configured integrally with the operation controller 70. More specifically, the data processer 43 and the operation controller 70 may be composed of at least one computer including a memory storing programs therein and a processer configured to perform arithmetic operations according to instructions contained in the programs.

In one embodiment, the polishing controller 60 may be configured integrally with the operation controller 70. More specifically, the polishing controller 60 and the operation controller 70 may be composed of at least one computer including a memory storing programs therein and a processer configured to perform arithmetic operations according to instructions contained in the programs.

According to this embodiment, the cover member 44 is not in contact with the polishing pad 2 and the transparent liquid can be supplied to the optical path during the measuring of the surface property of the polishing pad 2, so that any structural element does not damage the polishing surface 2*a* of the polishing pad 2 during the measuring. Furthermore, the surface property measuring system 40 may be permanently provided in the polishing apparatus for all time, so that a time of preparing for measuring is not required. Therefore, the surface property of the polishing pad 2 can be measured even in a short time, such as until polishing of a next substrate W is started.

Figure 10:
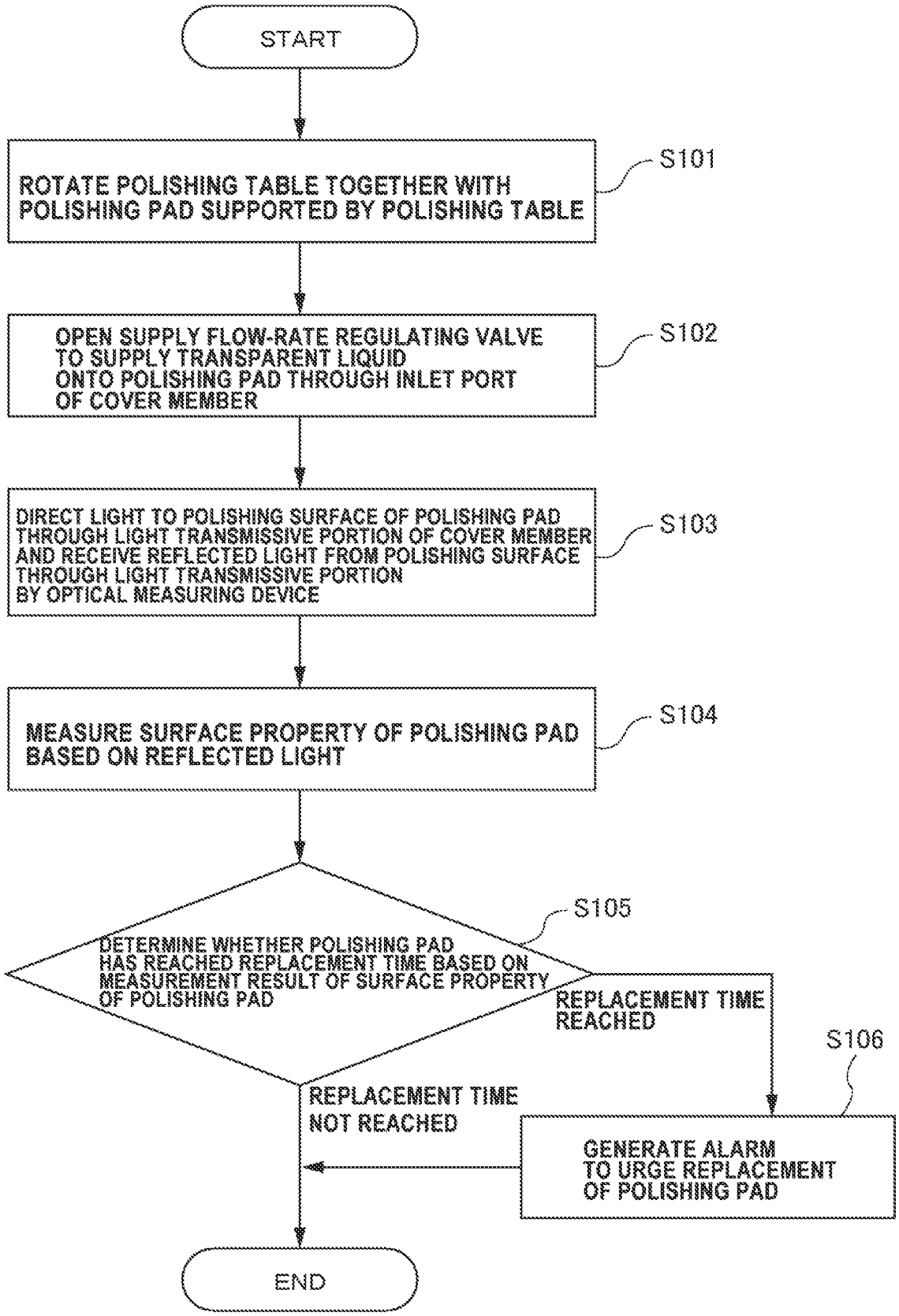
FIG. 10 is a flowchart showing an embodiment of measuring a surface property of the polishing pad.

FIG. 10 is a flowchart showing an embodiment of measuring the surface property of the polishing pad 2.

In step S101, the polishing controller 60 instructs the table motor 6 to rotate the polishing table 3 together with the polishing pad 2 while the polishing table 3 supports the polishing pad 2. The polishing table 3 may already be rotating together with the polishing pad 2, for example, during polishing of the substrate W with use of the polishing liquid or the pure water, during dressing of the polishing pad 2, after dressing of the polishing pad 2 and before polishing of a next substrate W is started, etc.

In step S102, the operation controller 70 instructs the supply flow-rate regulating valve 50 to open to supply the transparent liquid onto the polishing pad 2 through the inlet port 44*b* of the cover member 44. The gap between the cover member 44 and the polishing surface 2*a* of the polishing pad 2 is filled with the transparent liquid.

In step S103, the operation controller 70 instructs the measuring head 42 of the optical measuring device 41 to direct light to the polishing surface 2*a* of the polishing pad 2 through the light transmissive portion 44*a* of the cover member 44, and receive reflected light from the polishing surface 2*a* through the light transmissive portion 44*a*.

In step S104, the optical measuring device 41 measures the surface property of the polishing pad 2 based on the reflected light from the polishing surface 2*a*. More specifically, the data processer 43 of the optical measuring device 41 measures the surface property of the polishing pad 2 by performing data processing on the relationship between the distance D1 (see FIG. 3) determined based on the reflected light transmitted from the measuring head 42 and the measuring time T. The measurement result of the surface property of the polishing pad 2 is transmitted to the operation controller 70.

In step S105, the operation controller 70 determines whether a replacement time of the polishing pad 2*a* is reached based on the measurement result of the surface property of the polishing pad 2. When the operation controller 70 determines that a replacement time of the polishing pad 2*a* is reached, the operation controller 70 may emit an alarm to urge a replacement of the polishing pad 2 (step S106).

Figure 11:
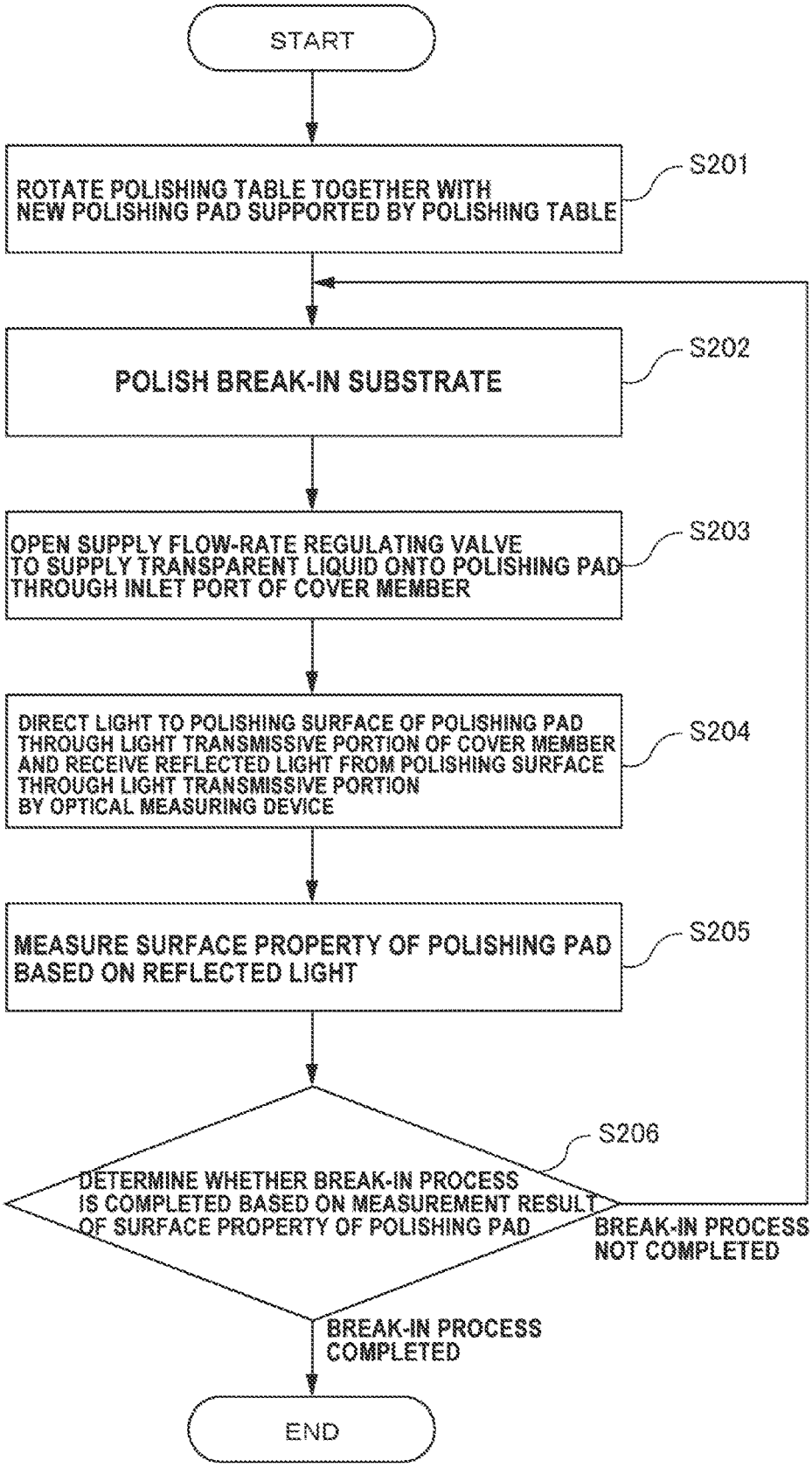
FIG. 11 is a flowchart showing another embodiment of measuring the surface property of the polishing pad.

FIG. 11 is a flowchart showing another embodiment of measuring the surface property of the polishing pad 2. In this embodiment, the surface property of the polishing pad 2 is measured for determining whether a break-in process of the polishing pad 2 is completed.

In step S201, a new (brand-new) polishing pad 2 is attached to the polishing table 3. The polishing controller 60 instructs the table motor 6 to rotate the polishing table 3 together with the polishing pad 2 while the polishing table 3 is supporting the new polishing pad 2.

In step S202, a break-in substrate (i.e., a dummy substrate) is polished for a break-in process of the polishing pad 2. Specifically, the polishing controller 60 instructs the polishing-liquid supply nozzle 5 to supply the polishing liquid onto the polishing surface 2*a* of the polishing pad 2 on the polishing table 3. The polishing controller 60 instructs the polishing head 1 to press the break-in substrate, held on the lower surface of the polishing head 1, against the polishing surface 2*a* of the polishing pad 2 while the polishing head 1 is rotating. The new polishing pad 2 does not have a stable surface roughness and a stable water absorption performance of the polishing surface 2*a*. Therefore, the surface property of the new polishing pad 2 changes during polishing of multiple substrates, and as a result, the new polishing pad 2 may fail to provide a stable polishing performance. Thus, polishing of the break-in substrate (dummy substrate) is performed so as to stabilize the surface property of the polishing pad 2 and improve the polishing performance of the polishing pad 2. Such a process for the new polishing pad 2 is referred "break-in process". The polishing pad 2 that has completed the break-in process has a uniform and stable surface property.

Steps S203 to S205 are the same as the steps S102 to S104 in FIG. 10, and duplicated descriptions will be omitted.

In step S206, the operation controller 70 determines whether the break-in process of the polishing pad 2 is completed based on the measurement result of the surface property of the polishing pad 2. When the operation controller 70 determines that the break-in process is not completed, the operation flow is returned to the step S202, and polishing of the break-in substrate is further performed. When the operation controller 70 determines that the break-in process is completed, the polishing of the break-in substrate is terminated. The polishing head 1 holds a substrate W to be actually processed, and polishes the substrate W using the polishing pad 2. The measuring of the surface property of the new polishing pad 2 may be performed at any time during or after polishing of the break-in substrate.

Figure 12:
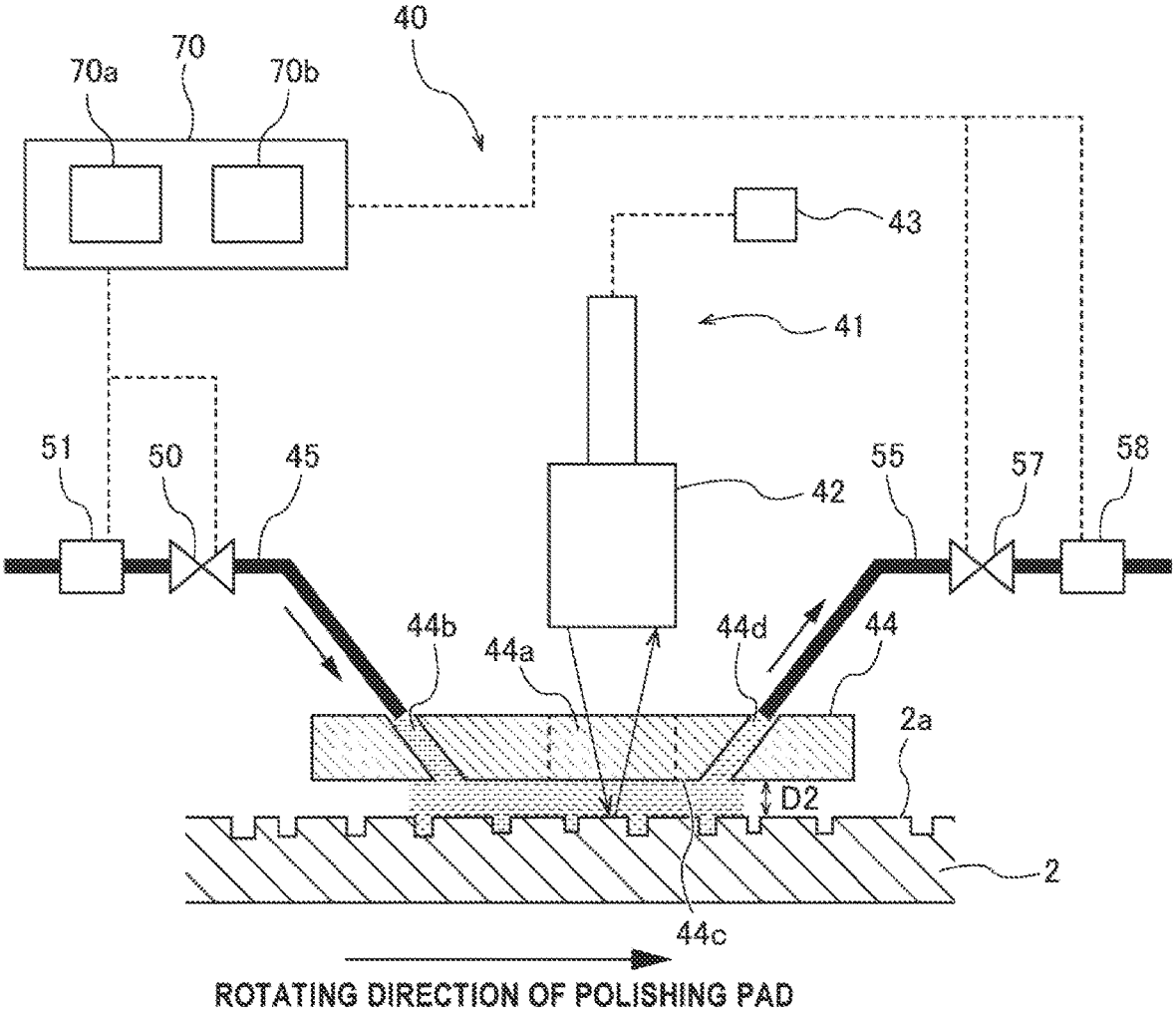
FIG. 12 is a schematic diagram showing another embodiment of the surface property measuring system.
Figure 13:
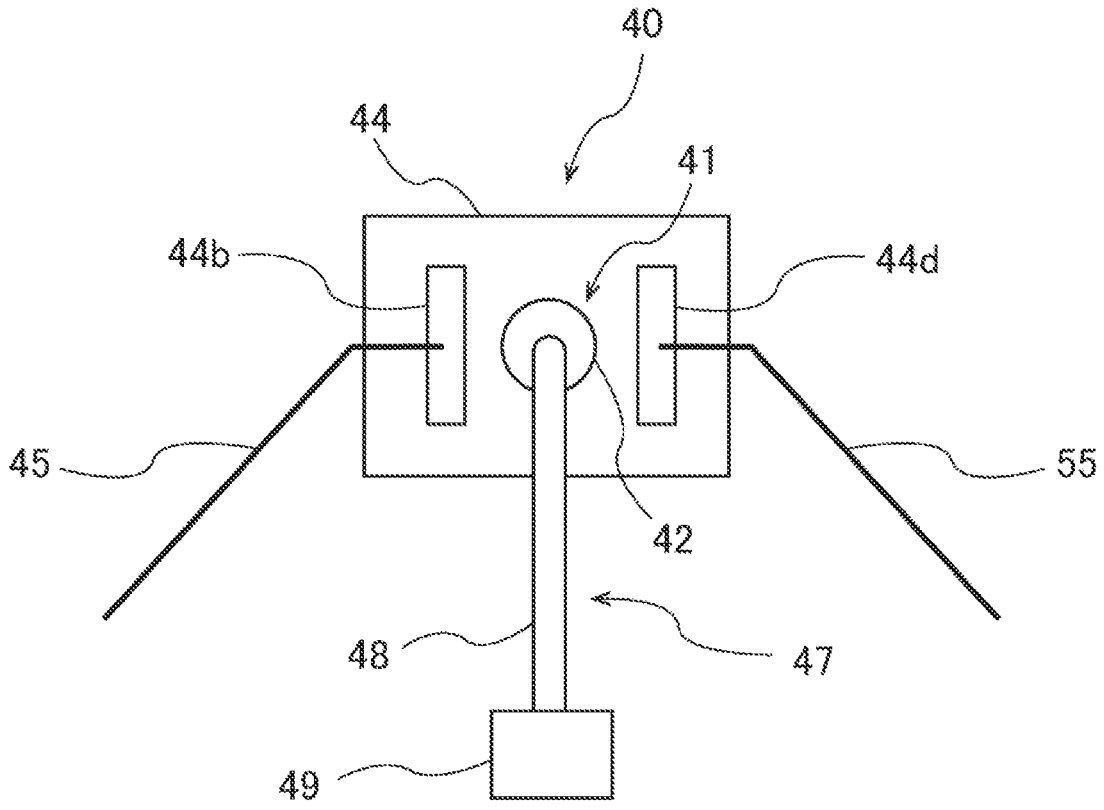
FIG. 13 is a plan view showing the surface property measuring system shown in FIG. 12.

FIG. 12 is a schematic diagram showing another embodiment of the surface property measuring system 40. FIG. 13 is a plan view of the surface property measuring system 40 shown in FIG. 12. Configurations of this embodiment, which will not be particularly described, are the same as those of the embodiment described with reference to FIG. 9, and duplicated descriptions will be omitted. In FIGS. 12 and 13, depiction of the cover-member height adjusting mechanism 53 is omitted. In this embodiment, a suction port 44*d* is further provided in the cover member 44, and the surface property measuring system 40 further includes a transparent-liquid suction line 55 coupled to the suction port 44*d*.

The suction port 44*d* is located downstream of the inlet port 44*b* and the light transmissive portion 44*a* in the rotating direction of the polishing pad 2. In other words, the suction port 44*d* is located downstream of the optical path of the light emitted from the measuring head 42 and the reflected light from the polishing surface 2*a*. In this embodiment, the suction port 44*d* is located downstream of the measuring head 42 of the optical measuring device 41.

The suction port 44*d* extends through the cover member 44 from its top to bottom and slopes downwardly toward the inside of the cover member 44. In one embodiment, the suction port 44*d* may extend through the cover member 44 in a direction perpendicular to the facing surface 44*c* of the cover member 44 without sloping. As shown in FIG. 13, the suction port 44*d* is a slit having a rectangular shape when viewed from above. The suction port 44*d* is not limited to this embodiment, and may be an opening having a circular shape or an oval shape when viewed from above.

The transparent-liquid suction line 55 is configured to suck the transparent liquid flowing through the gap between the cover member 44 and the polishing surface 2*a* of the polishing pad 2 through the suction port 44*d* The transparent liquid supplied from the transparent-liquid supply line 45 flows through the gap between the cover member 44 and the polishing surface 2*a* of the polishing pad 2 along the rotating direction of the polishing pad 2, and is sucked by the transparent-liquid suction line 55. More specifically, the transparent liquid supplied from the transparent-liquid supply line 45 through the inlet port 44*b* flows from the inlet port 44*b* via the light transmissive portion 44*a* toward the suction port 44*d*, and is sucked through the suction port 44*d* by the transparent-liquid suction line 55. The sucked transparent liquid is discharged out of the transparent-liquid suction line 55. In one embodiment, a flow rate of the transparent liquid supplied from the transparent-liquid supply line 45 is higher than a flow rate of the transparent liquid sucked by the transparent-liquid suction line 55.

According to this embodiment, the flow of the transparent liquid from the inlet port 44*b* to the suction line 44*d* is formed in the gap between the cover member 44 and the polishing surface 2*a* of the polishing pad 2, so that the optical path during the measuring of the surface property of the polishing pad 2 can be filled with the transparent liquid. Furthermore, a flow of the transparent liquid out of the cover member 44 can be prevented by sucking the transparent liquid on the polishing pad 2 by the transparent-liquid suction line 55. Therefore, when the surface property of the polishing pad 2 is measured during polishing of the substrate W with the polishing liquid, the polishing liquid can be prevented from being diluted by the transparent liquid. In addition, the surface property of the polishing pad 2 can be measured during polishing of the substrate W under conditions that the substrate W is actually being polished with the polishing liquid.

The surface property measuring system 40 further includes a suction flow-rate regulating valve 57 configured to be able to regulate a flow rate of the transparent liquid sucked by the transparent-liquid suction line 55 through the suction port 44*d*, and a flow meter 58 configured to measure the flow rate of the transparent liquid flowing through the transparent-liquid suction line 55. The suction flow-rate regulating valve 57 and the flow meter 58 are attached to the transparent-liquid suction line 55. The suction flow-rate regulating valve 57 is electrically connected to the operation controller 70, and operations of the suction flow-rate regulating valve 57 are controlled by the operation controller 70.

In one embodiment, the suction flow-rate regulating valve 57 may be manually operable.

The operation controller 70 instructs the supply flow-rate regulating valve 50 and the suction flow-rate regulating valve 57 to open the supply flow-rate regulating valve 50 and the suction flow-rate regulating valve 57 so that the transparent liquid is supplied onto the polishing pad 2 through the inlet port 44*b* of the cover member 44, while the transparent liquid on the polishing pad 2 is sucked by the transparent-liquid suction line 55 through the suction port 44*d*. Furthermore, the operation controller 70 instructs the optical measuring device 41 to measure the surface property of the polishing pad 2.

The flow rate of the transparent liquid sucked by the transparent-liquid suction line 55 through the suction port 44*d* is determined based on parameters, such as a rotating speed of the polishing table 3, a distance from the polishing surface 2*a* to the facing surface 44*c* of the cover member 44, a type of the polishing pad 2 (a material of the polishing pad 2, a shape of the recess formed in the polishing surface 2*a*, etc.), a type of the polishing liquid, and the flow rate of the transparent liquid supplied from the transparent-liquid supply line.

In one embodiment, suction flow-rate data indicating a relationship between parameters (e.g., the rotating speed of the polishing table 3, the distance from the polishing surface 2*a* to the facing surface 44*c* of the cover member 44, the type of polishing pad 2, the type of polishing liquid, and the flow rate of the transparent liquid supplied from the transparent-liquid supply line 45) and an optimal flow rate of the transparent liquid sucked by the transparent-liquid suction line 55 may be obtained in advance, and the suction flow-rate data may be stored in the operation controller 70. The operation controller 70 is coupled to the polishing controller 60 configured to control the operations of the polishing apparatus. The operation controller 70 may control the operations of the suction flow-rate regulating valve 57 based on each parameter obtained from the polishing controller 60 and the suction flow-rate data.

In another embodiment, the operation controller 70 may calculate the standard deviation of the measured value of the surface property obtained by the optical measuring device 41. If the standard deviation is larger than a predetermined threshold value (i.e., if a degree of variation is large), the operation controller 70 may control the operations of the supply flow-rate regulating valve 50 and/or the suction flow-rate regulating valve 57 so as to regulate the flow rate of the transparent liquid supplied from the transparent-liquid supply line 45 and/or the flow rate of the transparent liquid sucked by the transparent-liquid suction line 55. Alternatively, if the measured value of the surface property obtained by the optical measuring device 41 is smaller than the predetermined threshold value, the operation controller 70 may control the operations of the supply flow-rate regulating valve 50 and/or the suction flow-rate regulating valve 57 so as to regulate the flow rate of the transparent liquid supplied from the transparent-liquid supply line 45 and/or the flow rate of the transparent liquid sucked by the transparent-liquid suction line 55.

An optimum flow rate of the transparent liquid sucked by the transparent-liquid suction line 55 through the suction port 44*d* is such that the transparent liquid sufficiently fills the gap between the facing surface 44*c* of the cover member 44 and the polishing surface 2*a* of the polishing pad 2. If the flow rate of the transparent liquid sucked by the transparent-liquid suction line 55 is too low, flow of the transparent liquid out of the cover member 44 cannot be prevented. If the flow rate of the transparent liquid is too high, the transparent liquid on the polishing pad 2 is sucked more than necessary and the gap between the cover member 44 and the polishing surface 2*a* of the polishing pad 2 cannot be filled with the transparent liquid. In addition, the flow of the transparent liquid from the inlet port 44*b* to the suction port 44*d* may be turbulent, and bubbles may be generated.

Figure 14:
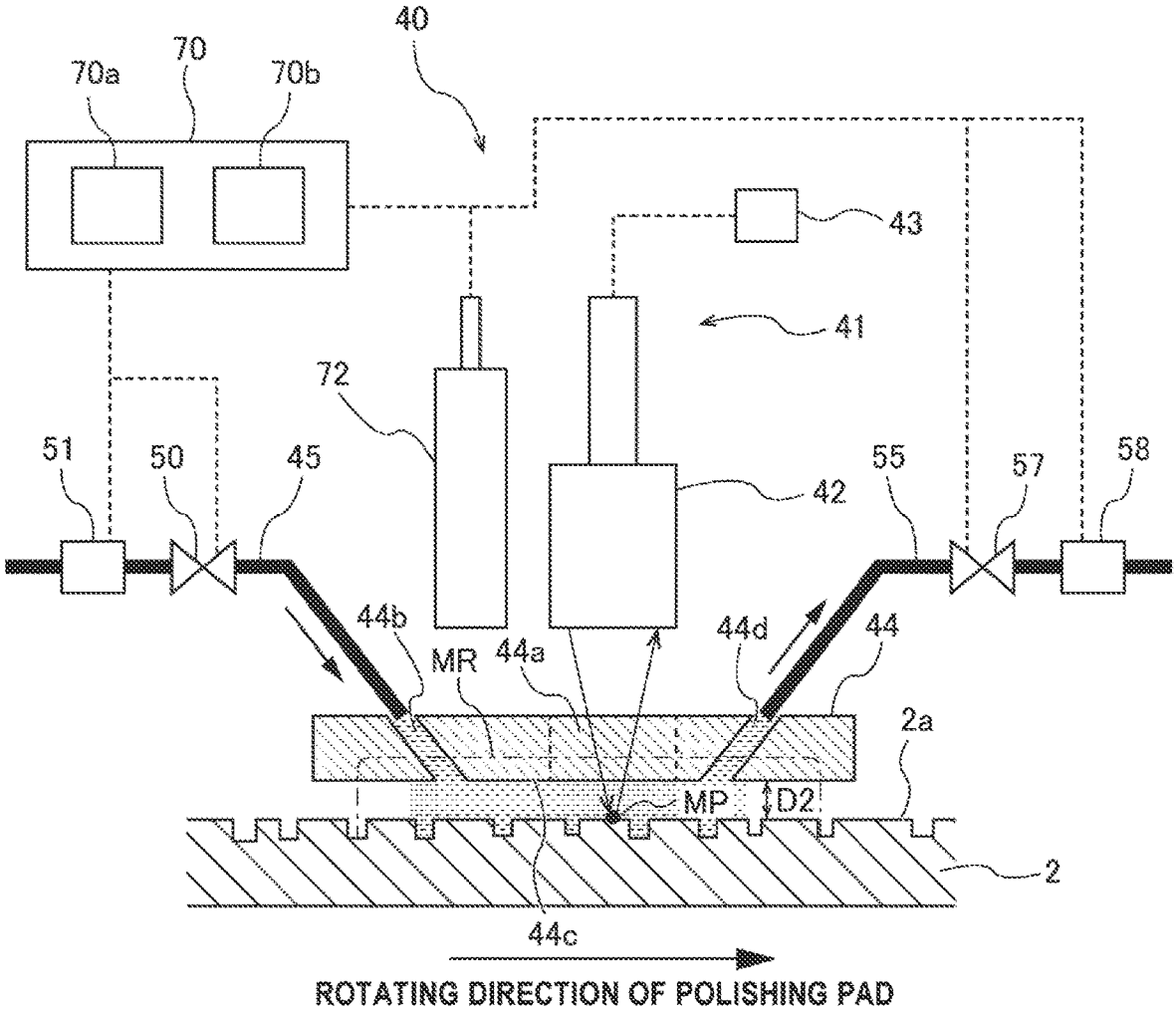
FIG. 14 is a schematic diagram showing still another embodiment of the surface property measuring system.

FIG. 14 is a schematic diagram showing still another embodiment of the surface property measuring system 40. Configurations of this embodiment, which is will not be particularly described, are the same as those of the embodiment described with reference to FIG. 12, and duplicated descriptions will be omitted. The surface property measuring system 40 of this embodiment further includes an imaging device 72. The imaging device 72 is disposed above the cover member 44, and is adjacent to the measuring head 42. The imaging device 72 is a camera including an imaging sensor, such as a CCD sensor or a CMOS sensor.

The imaging device 72 is configured to generate an image of a monitoring region MR. The monitoring region MR is indicated by a dash-dot-dash line in FIG. 14, and is a region including the measurement point MP on the polishing surface 2*a* of the polishing pad 2 where the light is applied by the optical measuring device 41 and the light is reflected. The monitoring region MR may include the inlet port 44*b* and the suction port 44*d* in the facing surface 44*c* of the cover member 44. In one embodiment, the surface property measuring system 40 may further include an illuminating device for illuminating the monitoring region MR of the polishing surface 2*a*.

The imaging device 72 is electrically connected to the operation controller 70. The image of the monitoring region MR generated by the imaging device 72 is transmitted to the operation controller 70. The operation controller 70 determines a condition of the transparent liquid flowing through the gap between the cover member 44 and the polishing surface 2*a* of the polishing pad 2 from the image of the monitoring region MR. More specifically, the operation controller 70 determines a disturbance in the flow of the transparent liquid based on the image of the monitoring region MR. For example, the operation controller 70 determines the condition of the transparent liquid, such as a presence of bubbles or air layers in the gap between the cover member 44 and the polishing surface 2*a* of the polishing pad 2, and a transparency of the transparent liquid (whether the transparent liquid is cloudy due to the polishing liquid).

The operation controller 70 is configured to control the operations of the supply flow-rate regulating valve 50 and the suction flow-rate regulating valve 57 based on the image of the monitoring region MR. In one embodiment, the operation controller 70 determines a presence of bubbles on the obtained image of the monitoring region MR. When the operation controller 70 determines that the flow of the transparent liquid is turbulent, the operation controller 70 operates the supply flow-rate regulating valve 50 so as to increase the flow rate of the transparent liquid supplied from the transparent-liquid supply line 45. For example, the operation controller 70 may operate the supply flow-rate regulating valve 50 so as to increase the flow rate of the transparent liquid supplied from the transparent-liquid supply line 45 when the number of bubbles on the obtained image of the monitoring region MR exceeds a predetermined threshold value.

In another embodiment, the operation controller 70 may determine whether the entire gap between the light transmissive portion 44*a* of the cover member 44 and the polishing surface 2*a* of the polishing pad 2 is filled with the transparent liquid based on the image of the monitoring region MR. When the operation controller 70 determines that the gap is not filled with the transparent liquid, the operation controller 70 may operate the supply flow-rate regulating valve 50 so as to increase the flow rate of the transparent liquid supplied from the transparent-liquid supply line 45, or may operate the suction flow-rate regulating valve 57 so as to decrease the flow rate of the transparent liquid sucked by the transparent-liquid suction line 55.

Further, in another embodiment, the operation controller 70 may be configured to generate an alarm when the operation controller 70 detects an abnormality in the flow of the transparent liquid on the polishing pad 2 based on the image of the monitoring region MP. More specifically, the operation controller 70 may be configured to generate an alarm when opening degree(s) of the supply flow-rate regulating valve 50 and/or the suction flow-rate regulating valve 57 has(have) reached a lower limit or an upper limit when controlling the operations of the supply flow-rate regulating valve 50 and/or the suction flow-rate regulating valve 57 as described above.

The imaging device 72 shown in FIG. 14 may also be applied to the embodiment described with reference to FIG. 9. In this case, the operation controller 70 is configured to control the operations of the supply flow-rate regulating valve 50 based on the image of the monitoring region MR.

Figure 15:
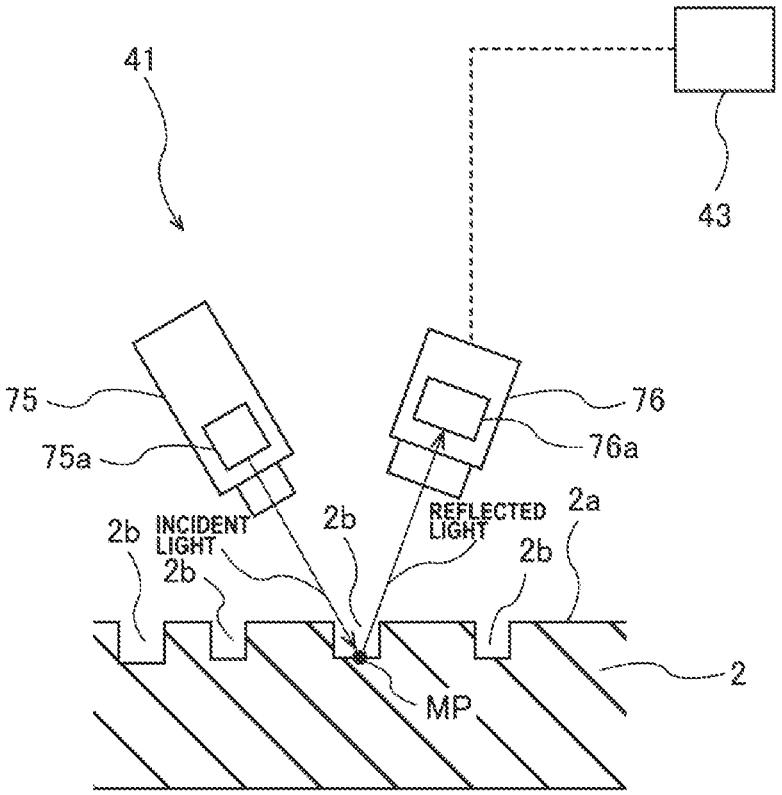
FIG. 15 is a schematic diagram showing another embodiment of the optical measuring device.

The surface property measuring system 40 of the embodiments described above includes the laser displacement meter as the measuring head 42 of the optical measuring device 41, and is configured to measure the surface profile of the polishing pad 2 based on the distance from the lower end of the measuring head 42 to the polishing surface 2*a* of the polishing pad 2, while the configuration of the optical measuring device 41 is not limited to these embodiments. FIG. 15 is a schematic diagram showing another embodiment of the optical measuring device 41. The optical measuring device 41 shown in FIG. 15 includes a first measuring head 75 having a light source 75*a*, a second measuring head 76 having a light receiving element 76*a*, and a data processer 43.

The first measuring head 75 directs light (laser light) from the light source 75*a* to the polishing surface 2*a* of the polishing pad 2, and the light receiving element 76*a* of the second measuring head 76 receives reflected light from the polishing surface 2*a*. The light receiving element 76*a* may be constituted of either a linear or a planar CCD element or a CMOS element having a dimension that can receive at least up to 4th-order diffracted light or up to 7th-order diffracted light reflected from the polishing surface 2*a*. The second measuring head 76 is coupled to the data processer 43. A measured value obtained by the second measuring head 76 is transmitted to the data processer 43, which analyzes the measured value.

The laser beam directed on the polishing surface 2*a* not only specularly reflects but also reflects over a wide range of angles through diffraction phenomenon according to the surface property of the polishing pad 2. In other words, information on the surface property of the polishing pad 2 can be obtained by receiving and analyzing the light reflected at the wide range of angles in addition to the specularly reflected component. In order to receive the light reflected at the wide range of angles, a linear or a planar light receiving element is required. Since the surface property of the polishing pad 2 is preferably contained in up to the 7th-order diffracted light, and is practically contained in up to the 4th-order diffracted light, the light receiving element should have a size that can receive diffracted light in this range. In this way, the optical measuring device 41 can measure the surface property of the polishing pad 2.

Figure 16:
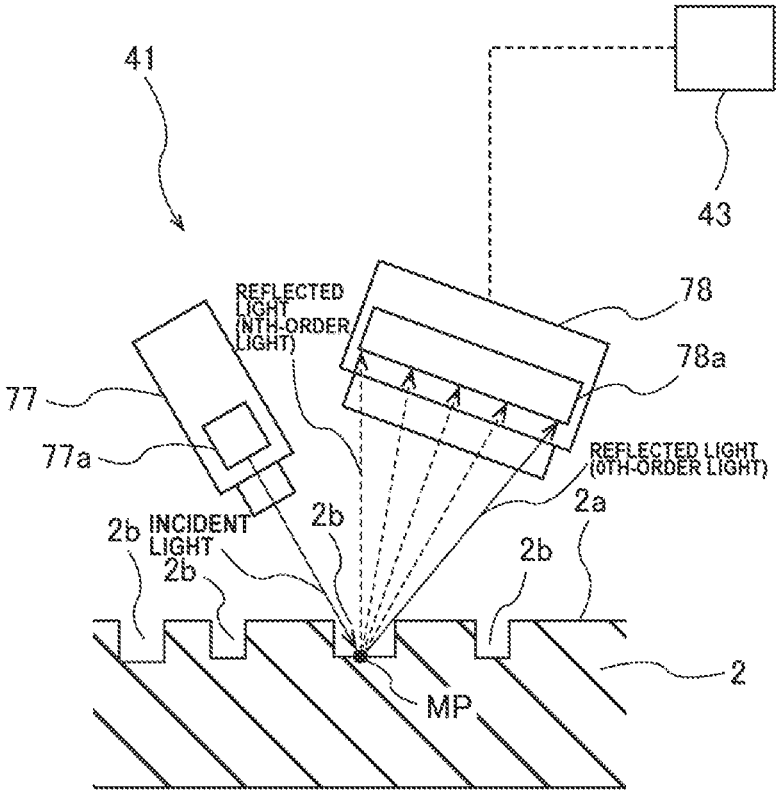
FIG. 16 is a schematic diagram showing still another embodiment of the optical measuring device.

FIG. 16 is a schematic diagram showing still another embodiment of the optical measuring device 41. The optical measuring device 41 shown in FIG. 16 includes a first measuring head 77 having a light source 77*a*, a second measuring head 78 having a light receiving element 78*a*, and a data processer 43.

The first measuring head 77 directs light (laser light) from the light source 77*a* to the polishing surface 2*a* of the polishing pad 2, and the light receiving element 78*a* of the second measuring head 78 receives reflected light from the polishing surface 2*a*. The reflected light from the polishing surface 2*a* contains scattered light from 0th-order light to nth-order light (n is a predetermined natural number) of the reflected light. The light receiving element 78*a* is configured to be able to receive scattered light around 0th-order light to 7th-order light reflected from the polishing surface 2*a*.

The second measuring head 78 is coupled to the data processer 43. A measured value obtained by the second measuring head 78 is transmitted to the data processer 43. The data processer 43 performs a spatial Fourier transform (or spatial fast Fourier transform) to generate a spectrum of the scattered light. The data processer 43 performs a known processing on this spectrum of the scattered light to calculate a surface property index, and measures the surface property of the polishing pad 2. The known processes for calculating the surface property index include, for example, calculating an integral value of a scattered-light intensity in a specific spatial wavelength region, and calculating a ratio of an integral value in a second spatial wavelength region to an integral value in a first spatial wavelength region. In this way, the optical measuring device 41 can measure the surface property of the polishing pad 2.

Figure 17:
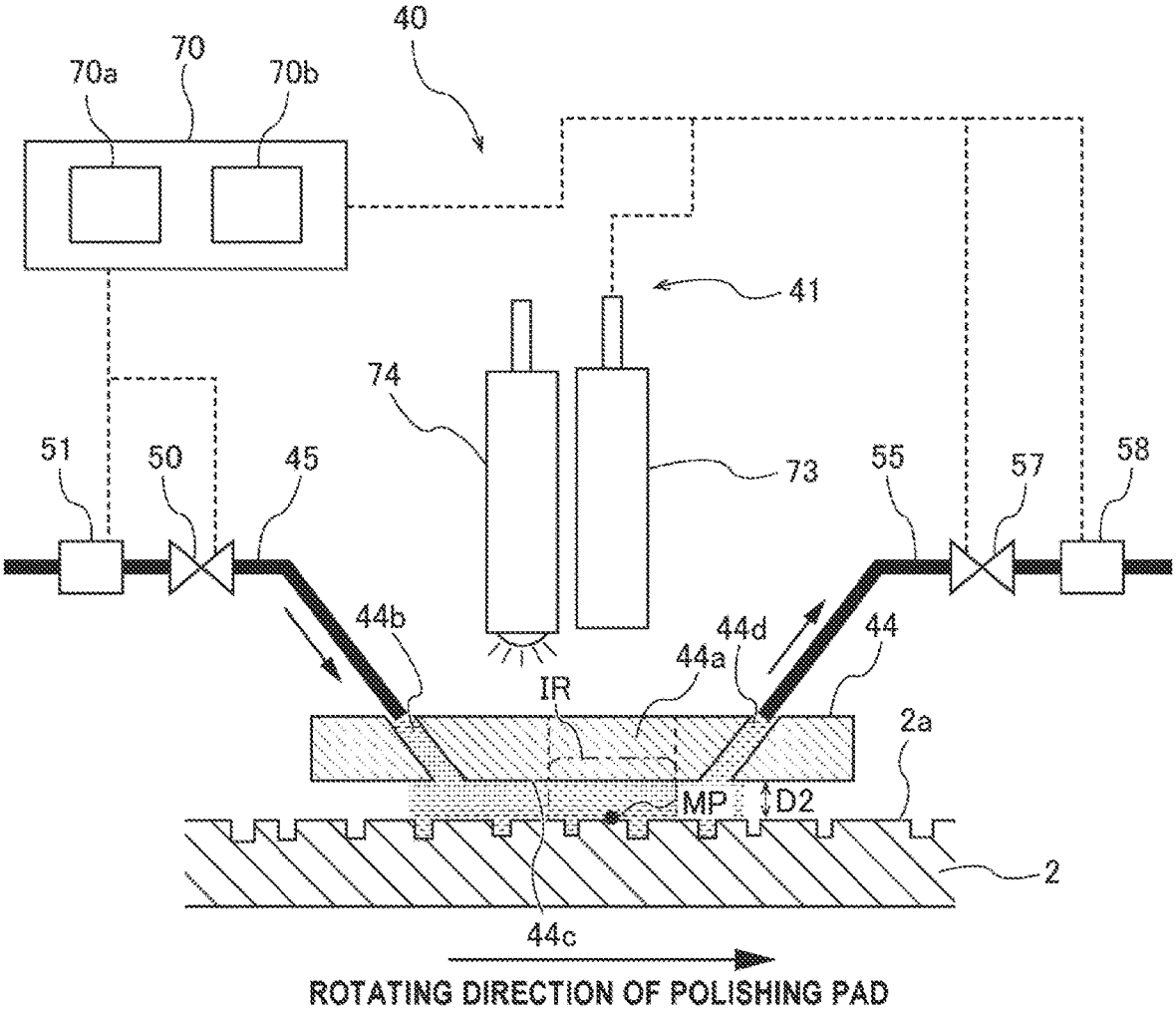
FIG. 17 is a schematic diagram showing still another embodiment of the optical measuring device.

FIG. 17 is a schematic diagram showing still another embodiment of the optical measuring device 41. The optical measuring device 41 shown in FIG. 17 includes a pad imaging device 73 that generates an image of the polishing surface 2*a* of the polishing pad 2, and an illuminating device 74 for illuminating the polishing surface 2*a*. The pad imaging device 73 is a camera including an imaging sensor, such as a CCD sensor or a CMOS sensor. The pad imaging device 73 may comprise the imaging device 72 described with reference to FIG. 14.

The illuminating device 74 is configured to illuminate the polishing surface 2*a* of the polishing pad 2 with light. The pad imaging device 73 is configured to generate an image of an imaging region IR based on reflected light from the polishing surface 2*a* The imaging region IR is indicated by a dash-dot-dash line in FIG. 17, and is a region including the measurement point MP on the polishing surface 2*a* that is illuminated by the illuminating device 74 through the light transmissive portion 44*a* of the optical measuring device 41. The pad imaging device 73 generates the image of an imaging region IR including the measurement point MP through the light transmissive portion 44*a* of the cover member 44. The imaging region IR may include the light transmissive portion 44*a* of the cover member 44. In this embodiment, the illuminating device 74 is arranged so as to emit the light perpendicularly to the polishing surface 2*a*, while an installation angle of the illuminating device 74 with respect to the polishing surface 2*a* is arbitrary and not limited to this embodiment as long as the imaging region IR can be illuminated.

The image of the imaging region IR shows the surface property of the polishing pad 2, such as conditions of the recesses formed in the polishing surface 2*a* and a condition of the polishing surface 2*a* (e.g., peeled portion or damage to the polishing surface 2*a*). Therefore, the optical measuring device 41 of this embodiment can measure the surface property of the polishing pad 2 by generating the image of the imaging region IR. The pad imaging device 73 is electrically connected to the operation controller 70. The measurement result of the surface property of the polishing pad 2, i.e., the image of the imaging region IR generated by the pad imaging device 73, is transmitted to the operation controller 70. The operation controller 70 determines whether the polishing pad 2 has reached a replacement time based on the image of the imaging region IR.

In one embodiment, the operation controller 70 may determine that the polishing pad 2 has reached a replacement time when no recesses of the polishing surface 2*a* appear in the image of the imaging region IR. In one embodiment, the operation controller 70 may determine that the polishing pad 2 has reached a replacement time when the operation controller 70 detects a peeled portion of the polishing surface 2*a* or damage to the polishing surface 2*a* that appears in the image of the imaging region IR. In one embodiment, the operation controller 70 may determine that the polishing pad 2 has reached a replacement time by performing known image processing (e.g., binarization processing) on the image of the imaging region IR to analyze the surface property of the polishing pad 2 included in the image of the imaging region IR. This image processing may be performed by the data processer 43 (not shown in FIG. 17) coupled to the pad imaging device 73, and the measurement result of the surface property of the polishing pad 2 analyzed by the data processer 43 may be transmitted to the operation controller 70.

The optical measuring device 41 shown in FIGS. 15 to 17 can be applied to any of the surface property measuring system 40 shown in FIGS. 9, 12, and 14, and below-described FIGS. 18 to 20.

The measuring of the surface property of the polishing pad 2 by the optical measuring device 41 may be performed while the polishing pad 2 is rotated as described above or the rotation of the polishing pad 2 is stopped.

Figure 18:
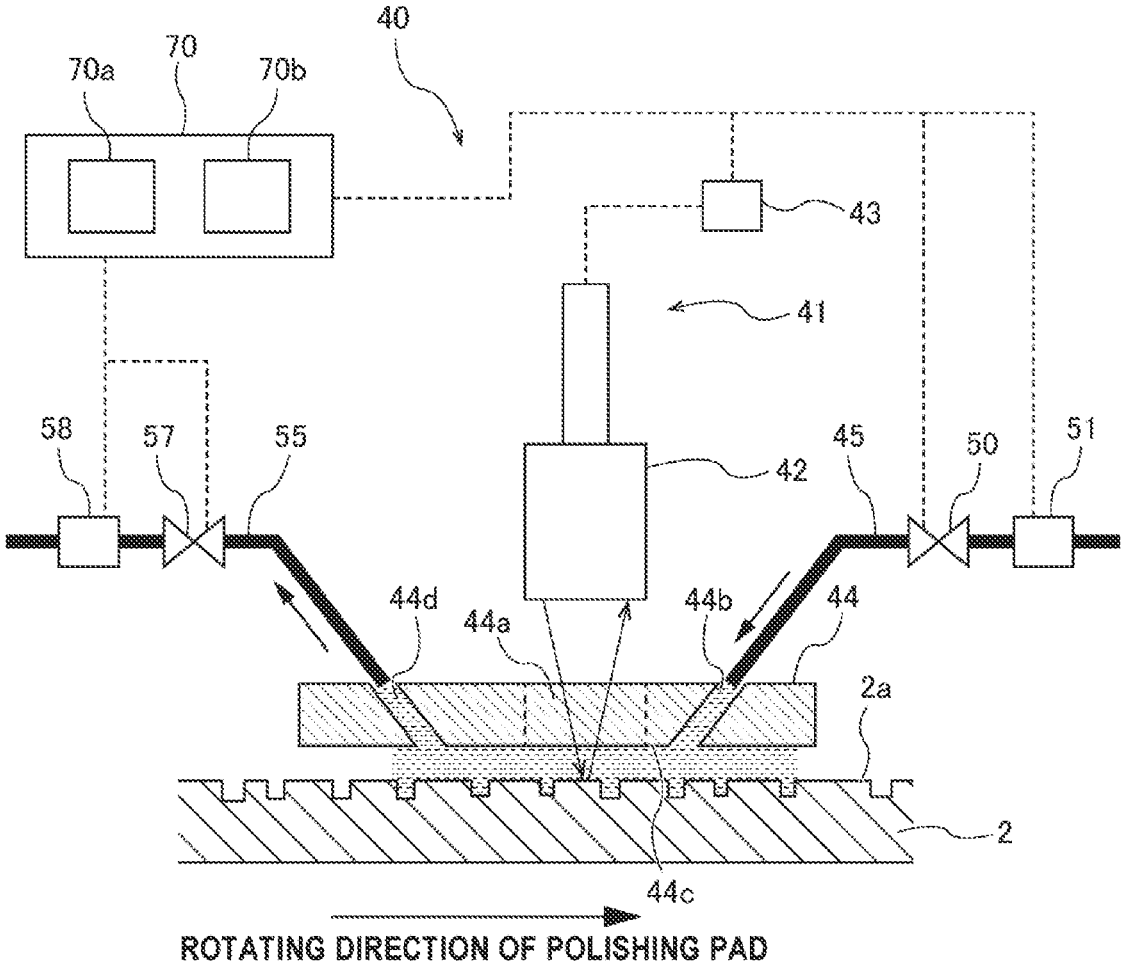
FIG. 18 is a schematic diagram showing still another embodiment of the surface property measuring system.

FIG. 18 is a schematic diagram showing still another embodiment of the surface property measuring system 40. Configurations of this embodiment, which will not be particularly described, are the same as those of the embodiment described with reference to FIG. 12, and duplicated descriptions will be omitted. In this embodiment, as shown in FIG. 18, the inlet port 44*b* of the cover member 44 is located downstream of the light transmissive portion 44*a* in the rotating direction of the polishing pad 2, and the suction port 44*d* is located upstream of the inlet port 44*b* and the light transmissive portion 44*a* in the rotating direction of the polishing pad 2. In other words, the inlet port 44*b* is located downstream of the optical path of the light emitted from the measuring head 42 and the reflected light from the polishing surface 2*a*, and the suction port 44*d* is located upstream of the optical path of the light emitted from the measuring head 42 and the reflected light from the polishing surface 2*a*. In this embodiment, the inlet port 44*b* is located downstream of the measuring head 42 of the optical measuring device 41, and the suction port 44*d* is located upstream of the measuring head 42 of the optical measuring device 41.

In this embodiment, the transparent liquid supplied from the transparent-liquid supply line 45 flows through the gap between the cover member 44 and the polishing surface 2*a* of the polishing pad 2 along a direction opposite to the rotating direction of the polishing pad 2, and is sucked by the transparent-liquid suction line 55. More specifically, the transparent liquid supplied from the transparent-liquid supply line 45 through the inlet port 44*b* flows from the inlet port 44*b* toward the suction port 44*d* via the light transmissive portion 44*a*, and is sucked through the suction port 44*d* by the transparent-liquid suction line 55. The sucked transparent liquid is discharged out of the transparent-liquid suction line 55.

In one embodiment, the surface property measuring system 40 may not include the transparent-liquid suction line 55, and may not have the suction port 44*d* in the cover member 44. In this case, the cover member 44 has the inlet port 44*b* located downstream of the light transmissive portion 44*a* in the rotating direction of the polishing pad 2. The transparent liquid supplied from the transparent-liquid supply line 45 flows through the gap between the cover member 44 and the polishing surface 2*a* of the polishing pad 2 along the direction opposite to the rotating direction of the polishing pad 2. Also in this case, the entire gap between the light transmissive portion 44*a* and the polishing surface 2*a* of the polishing pad 2 is filled with the transparent liquid.

Figure 19:
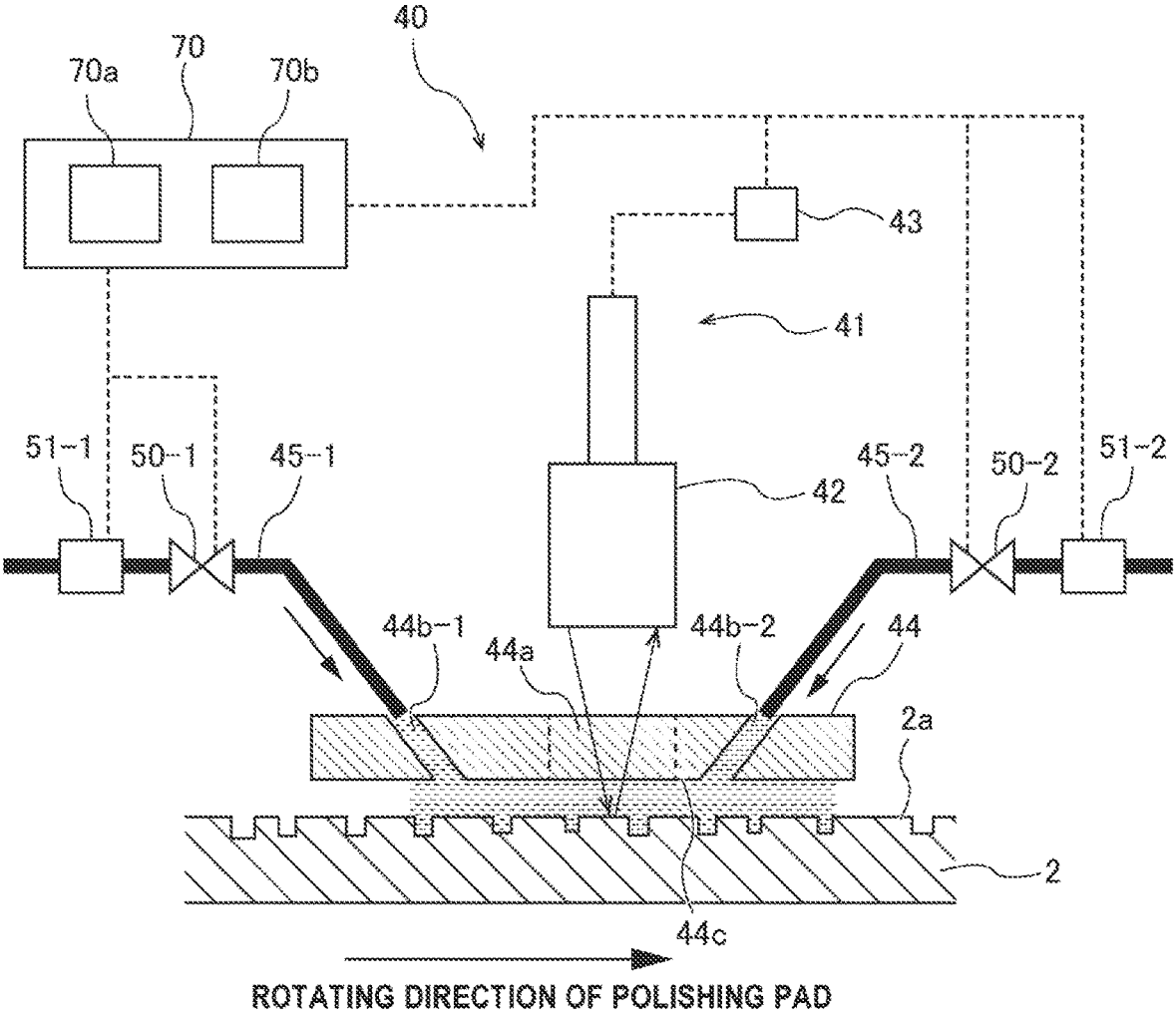
FIG. 19 is a schematic diagram showing still another embodiment of the surface property measuring system.

FIG. 19 is a schematic diagram showing still another embodiment of the surface property measuring system 40. Configurations of this embodiment, which will not be particularly described, are the same as those of the embodiment described with reference to FIG. 12, and duplicated descriptions will be omitted. The surface property measuring system 40 of this embodiment includes a first transparent-liquid supply line 45-1 and a second transparent-liquid supply line 45-2 instead of the transparent-liquid supply line 45 and the transparent-liquid suction line 55. The cover member 44 has a first inlet port 44*b*-1 and a second inlet port 44*b*-2 instead of the inlet port 44*b* and the suction port 44*d*.

The first inlet port 44*b*-1 is located upstream of the light transmissive portion 44*a* in the rotating direction of the polishing pad 2, and the second inlet port 44*b*-2 is located downstream of the first inlet port 44*b*-1 and the light transmissive portion 44*a*. In other words, the first inlet port 44*b*-1 is located upstream of the optical path of the light emitted from the measuring head 42 and the reflected light from the polishing surface 2*a*, and the second inlet port 44*b*-2 is located downstream of the optical path of the light emitted from the measuring head 42 and the reflected light from the polishing surface 2*a*. In this embodiment, the first inlet port 44*b*-1 is located upstream of the measuring head 42 of the optical measuring device 41, and the second inlet port 44*b*-2 is located downstream of the measuring head 42 of the optical measuring device 41.

The first transparent-liquid supply line 45-1 is coupled to the first inlet port 44*b*-1 of the cover member 44, and is configured to supply the transparent liquid onto the polishing pad 2 through the first inlet port 44*b*-1. The second transparent-liquid supply line 45-2 is coupled to the second inlet port 44*b*-2 of the cover member 44, and is configured to supply the transparent liquid onto the polishing pad 2 through the second inlet port 44*b*-2.

The surface property measuring system 40 further includes a first supply flow-rate regulating valve 50-1 configured to be able to regulate a flow rate of the transparent liquid supplied from the first transparent-liquid supply line 45-1 to the first inlet port 44*b*-1, and a first flow meter 51-1 configured to measure the flow rate of the transparent liquid flowing through the first transparent-liquid supply line 45-1. The first supply flow-rate regulating valve 50-1 and the first flow meter 51-1 are attached to the first transparent-liquid supply line 45-1. Similarly, the surface property measuring system 40 further includes a second supply flow-rate regulating valve 50-2 configured to be able to regulate a flow rate of the transparent liquid supplied from the second transparent-liquid supply line 45-2 to the second inlet port 44*b*-2, and a second flow meter 51-2 configured to measure the flow rate of the transparent liquid flowing through the second transparent-liquid supply line 45-2. The second supply flow-rate regulating valve 50-2 and the second flow meter 51-2 are attached to the second transparent-liquid supply line 45-2.

The first supply flow-rate regulating valve 50-1 and the second supply flow-rate regulating valve 50-2 are electrically connected to the operation controller 70, and operations of the first supply flow-rate regulating valve 50-1 and the second supply flow-rate regulating valve 50-2 are controlled by the operation controller 70. In one embodiment, the first supply flow-rate regulating valve 50-1 and the second supply flow-rate regulating valve 50-2 may be manually operable.

The transparent liquid supplied from the first transparent-liquid supply line 45-1 flows through the gap between the cover member 44 and the polishing surface 2*a* of the polishing pad 2 in the rotating direction of the polishing pad 2. The transparent liquid supplied from the second transparent-liquid supply line 45-2 flows through the gap between the cover member 44 and the polishing surface 2*a* of the polishing pad 2 in the direction opposite to the rotating direction of the polishing pad 2.

The surface property measuring system 40 is configured to supply the transparent liquid from at least one of the first transparent-liquid supply line 45-1 and the second transparent-liquid supply line 45-2. The surface property measuring system 40 operates the first supply flow-rate regulating valve 50-1 and the second supply flow-rate regulating valve 50-2 so as to selectively switch a line supplying the transparent liquid between the first transparent-liquid supply line 45-1 and the second transparent-liquid supply line 45-2. In one embodiment, the transparent liquid may be supplied from both the first transparent-liquid supply line 45-1 and the second transparent-liquid supply line 45-2.

The switching (selection) of the line supplying the transparent liquid, the flow rate of the transparent liquid supplied from the first transparent-liquid supply line 45-1 to the first inlet port 44*b*-1, and the flow rate of the transparent liquid supplied from the second transparent-liquid supply line 45-2 to the second inlet port 44*b*-2 are determined based on parameters, such as a rotating speed of the polishing table 3, a distance from the polishing surface 2*a* to the facing surface 44*c* of the cover member 44, a type of the polishing pad 2 (a material of the polishing pad 2, a shape of the recess formed in the polishing surface 2*a*, etc.), and a type of the polishing liquid.

Figure 20:
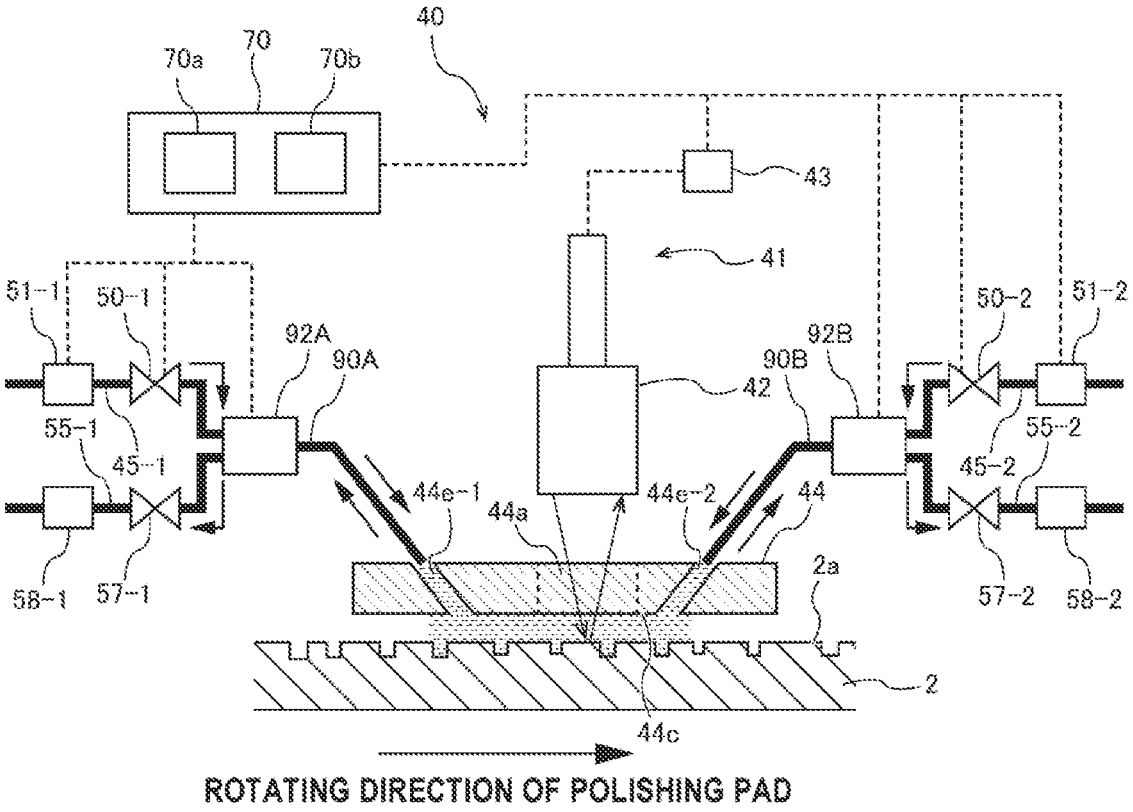
FIG. 20 is a schematic diagram showing still another embodiment of the surface property measuring system.

FIG. 20 is a schematic diagram showing still another embodiment of the surface property measuring system 40. Configurations of this embodiment, which will not be particularly described, are the same as those of the embodiment described with reference to FIG. 19, and duplicated descriptions will be omitted. The surface property measuring system 40 of this embodiment includes a first line 90A and a second line 90B instead of the first transparent-liquid supply line 45-1 and the second transparent-liquid supply line 45-2. The cover member 44 has a first inlet-suction port 44*e*-1 and a second inlet-suction port 44*e*-2 instead of the first inlet port 44*b*-1 and the second inlet port 44*b*-2. Each of the first inlet-suction port 44*e*-1 and the second inlet-suction port 44*e*-2 functions as the inlet port and the suction port described above.

The first inlet-suction port 44*e*-*l* is located upstream of the light transmissive portion 44*a* in the rotating direction of the polishing pad 2, and the second inlet-suction port 44*e*-2 is located downstream of the first inlet-suction port 44*e*-1 and the light transmissive portion 44*a* in the rotating direction of the polishing pad 2. In other words, the first inlet-suction port 44*e*-*l* is located upstream of the optical path of the light emitted from the measuring head 42 and the reflected light from the polishing surface 2*a*, and the second inlet-suction port 44*e*-2 is located downstream of the optical path of the light emitted from the measuring head 42 and the reflected light from the polishing surface 2*a*. In this embodiment, the first inlet-suction port 44*e*-1 is located upstream of the measuring head 42 of the optical measuring device 41, and the second inlet-suction port 44*e*-2 is located downstream of the measuring head 42 of the optical measuring device 41.

The first line 90A is coupled to the first inlet-suction port 44*e*-1 of the cover member 44, and the second line 90B is coupled to the second inlet-suction port 44*e*-2 of the cover member 44. The surface property measuring system 40 includes a first switching valve 92A coupled to the first line 90A, and a second switching valve 92B coupled to the second line 90B. Furthermore, the surface property measuring system 40 includes a first transparent-liquid supply line 45-1 and a first transparent-liquid suction line 55-1 coupled to the first line 90A via the first switching valve 92A, and a second transparent-liquid supply line 45-2 and a second transparent-liquid suction line 55-2 coupled to the second line 90B via the second switching valve 92B.

The first switching valve 92A is configured to be able to switch a line communicating with the first line 90A between the first transparent-liquid supply line 45-1 and the first transparent-liquid suction line 55-1. Similarly, the second switching valve 92B is configured to be able to switch a line communicating with the second line 90B between the second transparent-liquid supply line 45-2 and the second transparent-liquid suction line 55-2. When the first line 90A communicates with the first transparent-liquid supply line 45-1, the first transparent-liquid supply line 45-1 is configured to supply the transparent liquid onto the polishing pad 2 through the first inlet-suction port 44*e*-1. When the first line 90A communicates with the first transparent-liquid suction line 55-1, the first transparent-liquid suction line 55-1 is configured to suck the transparent liquid flowing through the gap between the cover member 44 and the polishing surface 2*a* of the polishing pad 2 through the first inlet-suction port 44*e*-1.

Similarly, when the second line 90B communicates with the second transparent-liquid supply line 45-2, the second transparent-liquid supply line 45-2 is configured to supply the transparent liquid onto the polishing pad 2 through the second inlet-suction port 44*e*-2. When the second line 90B communicates with the second transparent-liquid suction line 55-2, the second transparent-liquid suction line 55-2 is configured to suck the transparent liquid flowing through the gap between the cover member 44 and the polishing surface 2*a* of the polishing pad 2 through the second inlet-suction port 44*e*-2.

The surface property measuring system 40 further includes a first supply flow-rate regulating valve 50-1 configured to be able to regulate a flow rate of the transparent liquid supplied from the first transparent-liquid supply line 45-1 to the first inlet-suction port 44*e*-1, and a first flow meter 51-1 configured to measure the flow rate of the transparent liquid flowing through the first transparent-liquid supply line 45-1. The first supply flow-rate regulating valve 50-1 and the first flow meter 51-1 are attached to the first transparent-liquid supply line 45-1. The surface property measuring system 40 further includes a first suction flow-rate regulating valve 57-1 configured to be able to regulate a flow rate of the transparent liquid sucked by the first transparent-liquid suction line 55-1 through the first inlet-suction port 44*e*-1, and a first flow meter 58-1 configured to measure the flow rate of the transparent liquid flowing through the first transparent-liquid suction line 55-1. The first suction flow-rate regulating valve 57-1 and the first flow meter 58-1 are attached to the first transparent-liquid suction line 55-1. In one embodiment, the first switching valve 92A, the first supply flow-rate regulating valve 50-1, and the first suction flow-rate regulating valve 57-1 may be constituted of an integrated device.

Similarly, the surface property measuring system 40 further includes a second supply flow-rate regulating valve 50-2 configured to be able to regulate a flow rate of the transparent liquid supplied from the second transparent-liquid supply line 45-2 to the second inlet-suction port 44*e*-2, and a second flow meter 51-2 configured to measure the flow rate of the transparent liquid flowing through the second transparent-liquid supply line 45-2. The second supply flow-rate regulating valve 50-2 and the second flow meter 51-2 are attached to the second transparent-liquid supply line 45-2. The surface property measuring system 40 further includes a second suction flow-rate regulating valve 57-2 configured to be able to regulate a flow rate of the transparent liquid sucked by the second transparent-liquid suction line 55-2 through the second inlet-suction port 44*e*-2, and a second flow meter 58-2 configured to measure the flow rate of the transparent liquid flowing through the second transparent-liquid suction line 55-2. The second suction flow-rate regulating valve 57-2 and the second flow meter 58-2 are attached to the second transparent-liquid suction line 55-2. In one embodiment, the second switching valve 92B, the second supply flow-rate regulating valve 50-2, and the second suction flow-rate regulating valve 57-2 may be constituted of an integrated device.

The first switching valve 92A, the second switching valve 92B, the first supply flow-rate regulating valve 50-1, the first suction flow-rate regulating valve 57-1, the second supply flow-rate regulating valve 50-2, and the second suction flow-rate regulating valve 57-2 are electrically connected to the operation controller 70. Operations of the first switching valve 92A, the second switching valve 92B, the first supply flow-rate regulating valve 50-1, the first suction flow-rate regulating valve 57-1, the second supply flow-rate regulating valve 50-2, and the second suction flow-rate regulating valve 57-2 are controlled by the operation controller 70. In one embodiment, the first switching valve 92A, the second switching valve 92B, the first supply flow-rate regulating valve 50-1, the first suction flow-rate regulating valve 57-1, the second supply flow-rate regulating valve 50-2, and the second suction flow-rate regulating valve 57-2 may be manually operable.

The surface property measuring system 40 is configured to supply the transparent liquid from at least one of the first line 90A and the second line 90B. The surface property measuring system 40 selectively switches a line supplying the transparent liquid between the first line 90A communicating with the first transparent-liquid supply line 45-1 and the second line 90B communicating with the second transparent-liquid supply line 45-2 by the first switching valve 92A and the second switching valve 92B. In one embodiment, the transparent liquid may be supplied from both the first line 90A communicating with the first transparent-liquid supply line 45-1 and the second line 90B communicating with the second transparent-liquid supply line 45-2.

Furthermore, the surface property measuring system 40 may operate the first switching valve 92A and the second switching valve 92B to establish the fluid communication between the first line 90A or the second line 90B, which is not supplied with the transparent liquid, and the first transparent-liquid suction line 55-1 or the second transparent-liquid suction line 55-2 so as to suction the transparent liquid on the polishing pad 2. In one embodiment, the surface property measuring system 40 may not suck the transparent liquid on the polishing pad 2.

The switching (selection) of the lines communicating with the first line 90A and the second line 90B, the flow rate of the transparent liquid supplied from the first transparent-liquid supply line 45-1 to the first inlet-suction port 44*e*-1, the flow rate of the transparent liquid supplied from the second transparent-liquid supply line 45-2 to the second inlet-suction port 44*e*-2, the flow rate of the transparent liquid sucked by the first transparent-liquid suction line 55-1 through the first inlet-suction port 44*e*-1, and the flow rate of the transparent liquid sucked by the second inlet-suction port 44*e*-2 through the second inlet-suction port 44*e*-2 are determined based on parameters, such as a rotating speed of the polishing table 3, a distance from the polishing surface 2*a* to the facing surface 44*c* of the cover member 44, a type of the polishing pad 2 (a material of the polishing pad 2, a shape of the recess formed in the polishing surface 2*a*, etc.), and a type of the polishing liquid.

The surface property measuring system 40 shown in FIGS. 18 to 20 may further include the cover-member height adjusting mechanism 53 described with reference to FIG. 9, and the cover-member height adjusting mechanism 53 may be configured to adjust the height of the cover member 44. The surface property measuring system 40 shown in FIGS. 18 to 20 may further include the imaging device 72 described with reference to FIG. 14, and the operation controller 70 may be configured to control the operations of the supply flow-rate regulating valve 50, the first supply flow-rate regulating valve 50-1, the second supply flow-rate regulating valve 50-2, the suction flow-rate regulating valve 57, the first suction flow-rate regulating valve 57-1, and/or the second suction flow-rate regulating valve 57-2 based on the image of the monitoring region MR (see FIG. 14).

Figure 21:
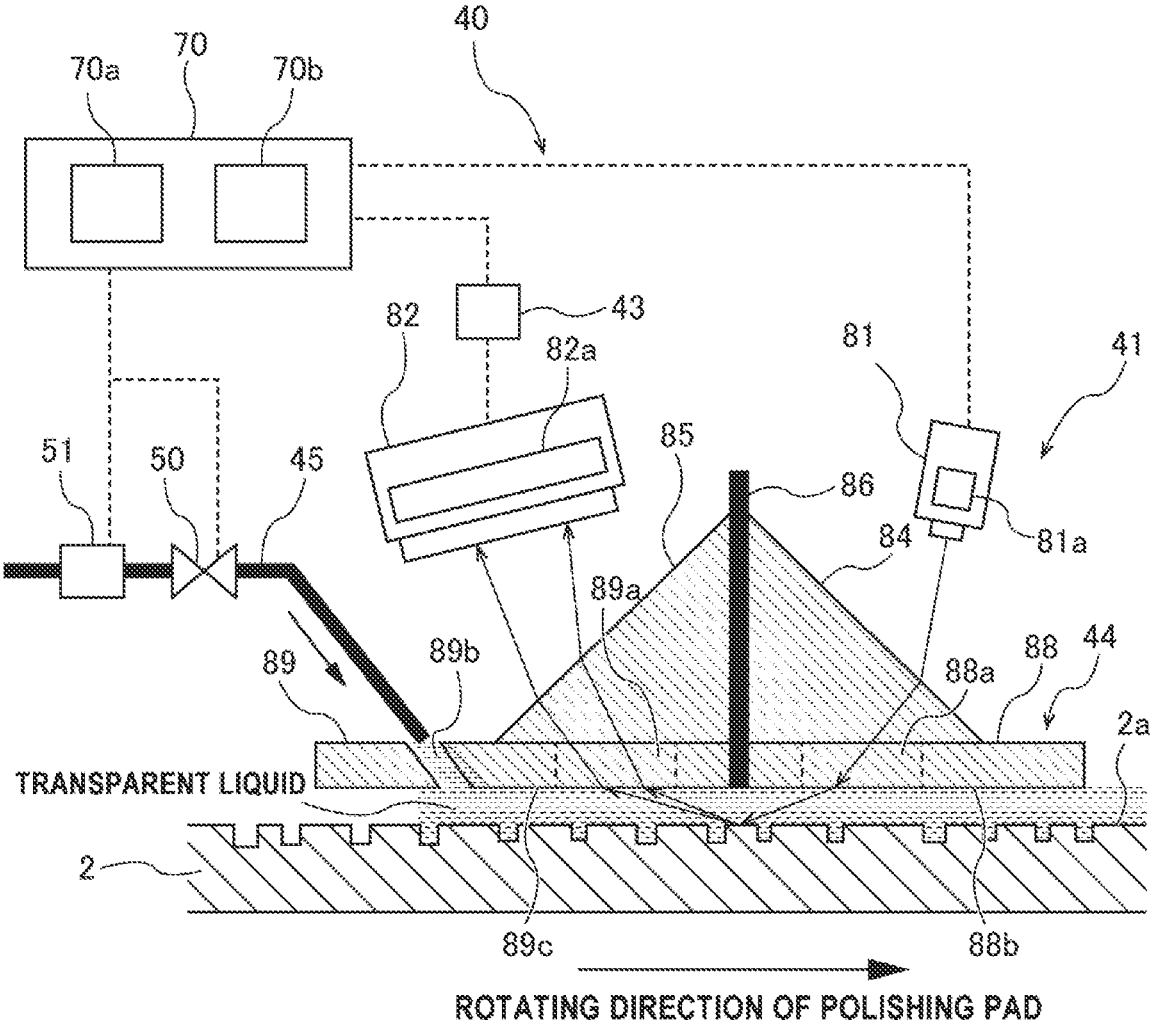
FIG. 21 is a schematic diagram showing still another embodiment of the surface property measuring system.

FIG. 21 is a schematic diagram showing still another embodiment of the surface property measuring system 40. Configurations of this embodiment, which will not be particularly described, are the same as those of the embodiment described with reference to FIG. 9, and duplicated descriptions will be omitted. The surface property measuring system 40 of this embodiment further includes a first prism 84, a second prism 85, and a light shielding member 86. The optical measuring device 41 of this embodiment includes a first measuring head 81 having a light source 81*a*, a second measuring head 82 having a light receiving element 82*a*, and a data processer 43 coupled to the second measuring head 82. The cover member 44 of this embodiment includes a first cover member 88 and a second cover member 89.

The first cover member 88 has a facing surface 88*b* parallel to the polishing surface 2*a* of the polishing pad 2. The first cover member 88 has a light transmissive portion 88*a* located on an optical path of light emitted by the first measuring head 81. The light transmissive portion 88*a* is a portion through which the light emitted by the first measuring head 81 passes, and is depicted with dashed line in FIG. 21. The light transmissive portion 88*a* is made of a transparent material through which the light emitted by the first measuring head 81 passes. In this embodiment, the first cover member 88 comprises a transparent plate, and the entire first cover member 88 including the light transmissive portion 88*a* is made of a transparent material.

The second cover member 89 has a facing surface 89*c* parallel to the polishing surface 2*a* of the polishing pad 2. The second cover member 89 has a light transmissive portion 89*a* located on an optical path of reflected light from the polishing surface 2*a*. The light transmissive portion 89*a* is a portion through which the reflected light from the polishing surface 2*a* passes, and is depicted with dashed line in FIG. 21. The light transmissive portion 89*a* is made of a transparent material through which the reflected light from the polishing surface 2*a* passes. In this embodiment, the second cover member 89 comprises a transparent plate, and the entire second cover member 89 including the light transmissive portion 89*a* is made of a transparent material.

The second cover member 89 has an inlet port 89*b* located upstream of the light transmissive portion 88*a* of the first cover member 88 and the light transmissive portion 89*a* of the second cover member 89 in the rotating direction of the polishing pad 2. In other words, the inlet port 89*b* is located upstream of the optical path of the light emitted from the first measuring head 81 and the reflected light from the polishing surface 2*a*. In this embodiment, the first cover member 88 and the second cover member 89 have the same thickness, and the facing surface 88*b* of the first cover member 88 and the facing surface 89*c* of the second cover member 89 lie in the same plane.

A transparent-liquid supply line 45 is coupled to the inlet port 89*b* of the second cover member 89, and is configured to supply the transparent liquid onto the polishing pad 2 through the inlet port 89*b*. As shown in FIG. 21, the entire cover member 44 (i.e., the first cover member 88 and the second cover member 89) is located away from the polishing surface 2*a* of the polishing pad 2. A gap between the facing surface of the cover member 44 (i.e., the facing surface 88*b* of the first cover member 88 and the facing surface 89*c* of the second cover member 89) and the polishing surface 2*a* of the polishing pad 2 is filled with a flow of the transparent liquid.

The first prism 84 and the second prism 85 are disposed between the optical measuring device 41 and the cover member 44. More specifically, the first prism 84 is disposed between the first measuring head 81 and the first cover member 88, and the second prism 85 is disposed between the second measuring head 82 and the second cover member 89. The first prism 84 and the first cover member 88 are joined by a transparent adhesive or the like that allows the light to pass therethrough. Similarly, the second prism 85 and the second cover member 89 are joined by a transparent adhesive or the like that allows the light to pass therethrough.

The light source 81*a* of the first measuring head 81 directs light (laser light) to the polishing surface 2*a* of the polishing pad 2 through the first prism 84, and the light receiving element 82*a* of the second measuring head 82 receives reflected light from the polishing surface 2*a* through the second prism 85. The data processer 43 measures the surface property of the polishing pad 2 by performing data processing on a measured value that has been measured based on the reflected light transmitted from the second measuring head 82. The measurement result of the surface property of the polishing pad 2 is transmitted to the operation controller 70. In one embodiment, the first measuring head 81 and the second measuring head 82 may have the same configurations as the first measuring head 75 and the second measuring head 76 described with reference to FIG. 15, or may have the same configurations as the first measuring head 77 and the second measuring head 78 described with reference to FIG. 16, or may have the same configurations as the pad imaging device 73 described with reference to FIG. 17. The optical measuring device 41 of this embodiment can accurately measure the surface property of the polishing pad 2 by directing the light to the polishing surface 2*a* at a low angle and reflecting the light off the polishing surface 2*a* at a low angle.

In order to direct the light to the polishing surface 2*a* at a low angle and reflect the light off the polishing surface 2*a* at a low angle, the first measuring head 81 and the second measuring head 82 should be arranged far away from the measurement point on the polishing surface 2*a*, so that the overall size of the optical measuring device 41 may increases. Thus, the surface property measuring system 40 of this embodiment includes the first prism 84 and the second prism 85 configured to deflect an optical path. The first prism 84 is configured to allow the light from the optical measuring device 41 to pass therethrough and is configured to deflect the optical path of the light. More specifically, the first prism 84 is configured to deflect the light emitted from the light source 81*a* of the first measuring head 81.

The second prism 85 is configured to allow the reflected light from the polishing surface 2*a* to pass therethrough, and is configured to deflect the optical path of the reflected light. More specifically, the second prism 85 is configured to deflect the reflected light from the polishing surface 2*a*. These configurations allow the entire optical measuring device 41 to be made compact while allowing the optical measuring device 41 to direct the light to the polishing surface 2*a* at a low angle and reflect the light off the polishing surface 2*a* at a low angle.

The light shielding member 86 is disposed between the first prism 84 and the second prism 85, and is configured to block light between the first prism 84 and the second prism 85. Further, the light shielding member 86 is disposed between the first cover member 88 and the second cover member 89, and is configured to block light between the first cover member 88 and the second cover member 89. In this embodiment, the light shielding member 86 is constituted of a black light-shielding plate. An upper portion of the light shielding member 86 protrudes upward from apexes of the first prism 84 and the second prism 85, and a lower end of the light shielding member 86 lies in the same plane as the facing surface 88*b* of the first cover member 88 and the facing surface 89*c* of the second cover member 89. Thus, the light shielding member 86 extends at least from the apexes of the first prism 84 and the second prism 85 to the facing surface 88*b* of the first cover member 88 and the facing surface 89*c* of the second cover member 89.

In one embodiment, the light shielding member 86 may be constituted of a black filler (e.g., silicone rubber, etc.) that fills a gap between the first prism 84 and the second prism 85 and a gap between the first cover member 88 and the second cover member 89. The light shielding member 86 and the first cover member 88 are tightly adhered to each other with no gap formed between the light shielding member 86 and the first cover member 88. Similarly, the light shielding member 86 and the second cover member 89 are tightly adhered to each other with no gap formed between the light shielding member 86 and the second cover member 89. The configuration of the light shielding member 86 is arbitrary and is not limited to this embodiment as long as the light shielding member 86 blocks the light between the first prism 84 and the second prism 85 and between the first cover member 88 and the second cover member 89 and seals the gap between the first cover member 88 and the second cover member 89.

The light shielding member 86 blocks the light between the first prism 84 and the second prism 85 to thereby prevent the light that has passed through the first prism 84 from passing through the second prism 85 without reaching the polishing surface 2*a*. Similarly, the light shielding member 86 blocks the light between the first cover member 88 and the second cover member 89 to thereby prevent the light that has passed through the first cover member 88 from passing through the second cover member 89 without reaching the polishing surface 2*a*. In other words, the light shielding member 86 prevents shortcut of the light between the first prism 84 and the second prism 85 and prevents shortcut of the light between the first cover member 88 and the second cover member 89.

In this embodiment, the first measuring head 81 is located downstream of the second measuring head 82 in the rotating direction of the polishing pad 2, the first prism 84 is located downstream of the second prism 85 in the rotating direction of the polishing pad 2, and the first cover member 88 is located downstream of the second cover member 89 in the rotating direction of the polishing pad 2. In one embodiment, the first measuring head 81 may be located upstream of the second measuring head 82 in the rotating direction of the polishing pad 2, the first prism 84 may be located upstream of the second prism 85 in the rotating direction of the polishing pad 2, and the first cover member 88 may be located upstream of the second cover member 89 in the rotating direction of the polishing pad 2. In this case, instead of providing the above-described inlet port 89*b* of the second cover member 89, the first cover member 88 has an inlet port located upstream of the light transmissive portion 88*a* of the first cover member 88 and the light transmissive portion 89*a* of the second cover member 89 in the rotating direction of the polishing pad 2. The transparent-liquid supply line 45 is coupled to the inlet port of the first cover member 88, and is configured to supply the transparent liquid onto the polishing pad 2 through the inlet port of the first cover member 88.

Figure 22:
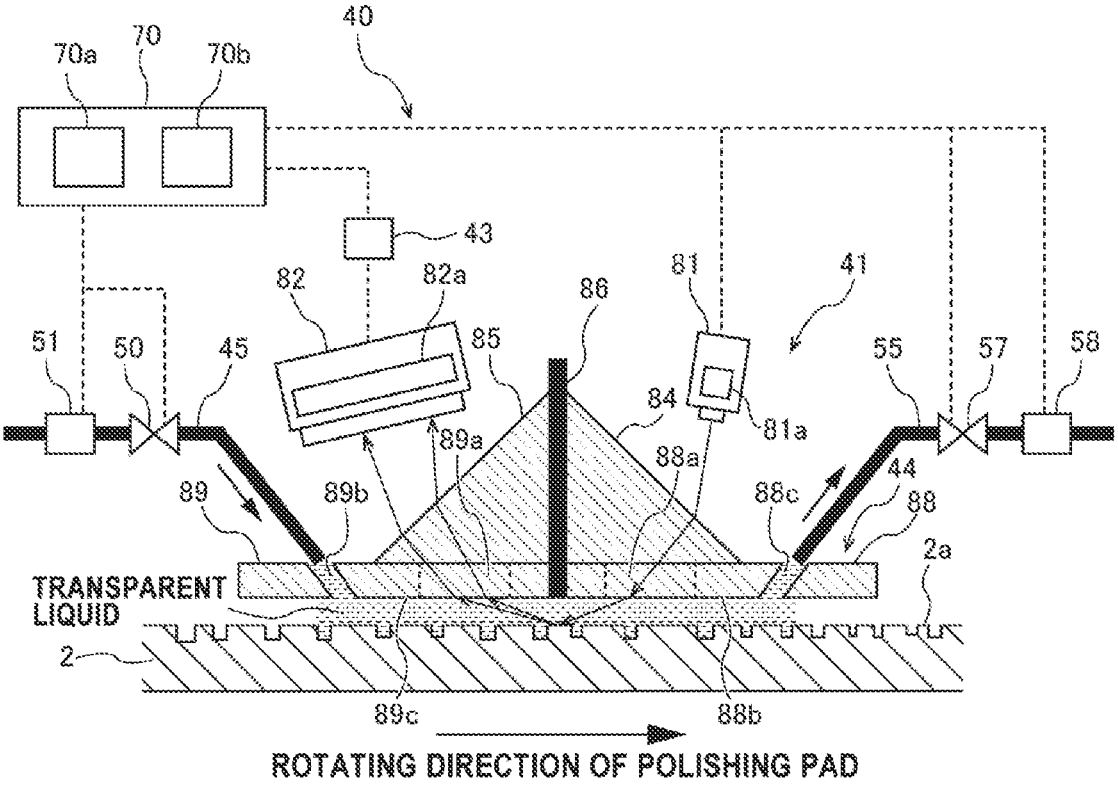
FIG. 22 is a schematic diagram showing still another embodiment of the surface property measuring system.

FIG. 22 is a schematic diagram showing still another embodiment of the surface property measuring system 40. Configurations of this embodiment, which will not be particularly described, are the same as those of the embodiment described with reference to FIG. 21, and duplicated descriptions will be omitted. In this embodiment, the first cover member 88 has a suction port 88*c*, and the surface property measuring system 40 further includes a transparent-liquid suction line 55 coupled to the suction port 88*c*. A configuration of the inlet port 88*c*, which will not be particularly described, is the same as the configuration of the suction port 44*d* of the embodiment described with reference to FIG. 12, and duplicated descriptions will be omitted.

The suction port 88*c* is located downstream of the inlet port 89*b* and the light transmissive portion 89*a* of the second cover member 89, and the light transmissive portion 88*a* of the first cover member 88 in the rotating direction of the polishing pad 2. In other words, the suction port 88*c* is located downstream of the optical path of the light emitted from the first measuring head 81 and the optical path of the reflected light from the polishing surface 2*a*. The transparent-liquid suction line 55 is configured to suck the transparent liquid flowing through the gap between the cover member 44 (i.e., the first cover member 88 and the second cover member 89) and the polishing surface 2*a* of the polishing pad 2 through the suction port 88*c*.

According to this embodiment, a flow of the transparent liquid from the inlet port 89*b* to the suction port 88*c* is formed in the gap between the cover member 44 (i.e., the first cover member 88 and the second cover member 89) and the polishing surface 2*a* of the polishing pad 2, so that the optical path during the measuring of the surface property of the polishing pad 2 can be filled with the transparent liquid. In addition, a flow of the transparent liquid out of the cover member 44 (i.e., first cover member 88 and second cover member 89) can be prevented by sucking the transparent liquid on the polishing pad 2 by the transparent-liquid suction line 55. Therefore, when the surface property of the polishing pad 2 is measured during the polishing of the substrate W with the polishing liquid, the polishing liquid is prevented from being diluted by the transparent liquid. In addition, the surface property of the polishing pad 2 can be measured during polishing of the substrate W under conditions that the substrate W is actually being polished with the polishing liquid.

In this embodiment, the first measuring head 81 is located downstream of the second measuring head 82 in the rotating direction of the polishing pad 2, the first prism 84 is located downstream of the second prism 85 in the rotating direction of the polishing pad 2, and the first cover member 88 is located downstream of the second cover member 89 in the rotating direction of the polishing pad 2.

In one embodiment, the first measuring head 81 may be located upstream of the second measuring head 82 in the rotating direction of the polishing pad 2, the first prism 84 may be located upstream of the second prism 85 in the rotating direction of the polishing pad 2, and the first cover member 88 may be located upstream of the second cover member 89 in the rotating direction of the polishing pad 2. In this case, instead of providing the above-described inlet port 89*b* of the second cover member 89, the first cover member 88 has an inlet port located upstream of the light transmissive portion 88*a* of the first cover member 88 and the light transmissive portion 89*a* of the second cover member 89 in the rotating direction of the polishing pad 2. The transparent-liquid supply line 45 is coupled to the inlet port of the first cover member 88, and is configured to supply the transparent liquid onto the polishing pad 2 through the inlet port of the first cover member 88. Furthermore, instead of providing be above-described suction port 88*c* of the first cover member 88, the second cover member 89 has a suction port located downstream of the inlet port of the first cover member 88, the light transmissive portion 88*a* of the first cover member 88, and the light transmissive portion 89*a* of the second cover member 89 in the rotating direction of the polishing pad 2. The transparent-liquid suction line 55 is coupled to the suction port of the second cover member 89, and is configured to suck the transparent liquid flowing through the gap between the cover member 44 (i.e., the first cover member 88 and the second cover member 89) and the polishing surface 2*a* of the polishing pad 2 through the suction port of the second cover member 89.

The surface property measuring system 40 shown in FIGS. 21 and 22 may further include the cover-member height adjusting mechanism 53 described with reference to FIG. 9. The cover-member height adjusting mechanism 53 may be configured to adjust a height of the cover members 44 (i.e., the first cover member 88 and second cover member 89). In this case, the cover-member height adjusting mechanism 53 is configured to adjust heights of the cover member 44, the first prism 84, the second prism 85, and the light shielding member 86 together. The surface property measuring system 40 shown in FIGS. 21 and 22 may further include the imaging device 72 described with reference to FIG. 14, and the operation controller 70 may be configured to control the operations of the supply flow-rate regulating valve 50 and/or the suction flow-rate regulating valve 57 based on the image of the monitoring region MR (see FIG. 14).

The embodiment shown in FIG. 22 may be combined with the embodiments described with reference to FIGS. 18 to 20.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A surface property measuring system comprising:

an optical measuring device configured to direct light to a polishing surface of a polishing pad when the polishing pad is rotating, and measure a surface property of the polishing pad based on reflected light from the polishing surface;

a cover member disposed between the optical measuring device and the polishing pad, the cover member having a light transmissive portion on an optical path of the light and the reflected light;

a transparent-liquid supply line coupled to an inlet port provided in the cover member, the transparent-liquid supply line being configured to supply a transparent liquid onto the polishing pad through the inlet port; and a supply flow-rate regulating valve configured to be able to regulate a flow rate of the transparent liquid to be supplied from the transparent-liquid supply line.

2. The surface property measuring system according to claim 1, wherein the inlet port is located upstream of the light transmissive portion in a rotating direction of the polishing pad.

3. The surface property measuring system according to claim 1, wherein the inlet port is located downstream of the light transmissive portion in a rotating direction of the polishing pad.

4. The surface property measuring system according to claim 1, further comprising a transparent-liquid suction line coupled to a suction port provided in the cover member, the transparent-liquid suction line being configured to suck the transparent liquid on the polishing pad through the suction port.

5. The surface property measuring system according to claim 1, wherein the cover member has a facing surface parallel to the polishing surface of the polishing pad.

6. The surface property measuring system according to claim 5, wherein a distance from the polishing surface of the polishing pad to the facing surface is 5 mm or less.

7. The surface property measuring system according to claim 1, further comprising a cover-member height adjusting mechanism configured to adjust a height of the cover member with respect to the polishing surface.

8. The surface property measuring system according to claim 1, further comprising an imaging device configured to generate an image of a monitoring region including a measurement point on the polishing surface where the light is applied and the light is reflected.

9. A polishing apparatus comprising:

the surface property measuring system according to claim 1;

a polishing table configured to support the polishing pad;

a table motor configured to rotate the polishing table together with the polishing pad; and a polishing head configured to press a substrate against the polishing surface of the polishing pad to polish the substrate.

10. A surface property measuring system comprising:

an optical measuring device configured to direct light to a polishing surface of a polishing pad when the polishing pad is rotating, and measure a surface property of the polishing pad based on reflected light from the polishing surface;

a cover member disposed between the optical measuring device and the polishing pad, the cover member having a light transmissive portion on an optical path of the light and the reflected light;

a transparent-liquid supply line coupled to an inlet port provided in the cover member, the transparent-liquid supply line being configured to supply a transparent liquid onto the polishing pad through the inlet port;

a transparent-liquid suction line coupled to a suction port provided in the cover member, the transparent-liquid suction line being configured to suck the transparent liquid on the polishing pad through the suction port; and a suction flow-rate regulating valve configured to be able to regulate a flow rate of the transparent liquid to be sucked by the transparent-liquid suction line.

11. A surface property measuring system comprising:

an optical measuring device configured to direct light to a polishing surface of a polishing pad when the polishing pad is rotating, and measure a surface property of the polishing pad based on reflected light from the polishing surface;

a cover member disposed between the optical measuring device and the polishing pad, the cover member having a light transmissive portion on an optical path of the light and the reflected light;

a transparent-liquid supply line coupled to an inlet port provided in the cover member, the transparent-liquid supply line being configured to supply a transparent liquid onto the polishing pad through the inlet port;

an imaging device configured to generate an image of a monitoring region including a measurement point on the polishing surface where the light is applied and the light is reflected;

a supply flow-rate regulating valve configured to be able to regulate a flow rate of the transparent liquid to be supplied from the transparent-liquid supply line; and an operation controller configured to control an operation of the supply flow-rate regulating valve based on the image of the monitoring region.

12. The surface property measuring system according to claim 11, further comprising:

a transparent-liquid suction line coupled to a suction port provided in the cover member, the transparent-liquid suction line being configured to suck the transparent liquid on the polishing pad through the suction port; and a suction flow-rate regulating valve configured to be able to regulate a flow rate of the transparent liquid to be sucked by the transparent-liquid suction line, wherein the operation controller is configured to control an operation of the suction flow-rate regulating valve based on the image of the monitoring region.

13. The surface property measuring system according to claim 12, wherein the operation controller is configured to generate an alarm when the operation controller detects an abnormality in a flow of the transparent liquid on the polishing pad based on the image of the monitoring region.

14. A surface property measuring system comprising:

an optical measuring device configured to direct light to a polishing surface of a polishing pad when the polishing pad is rotating, and measure a surface property of the polishing pad based on reflected light from the polishing surface;

a cover member disposed between the optical measuring device and the polishing pad, the cover member having a light transmissive portion on an optical path of the light and the reflected light;

a transparent-liquid supply line coupled to an inlet port provided in the cover member, the transparent-liquid supply line being configured to supply a transparent liquid onto the polishing pad through the inlet port;

a first prism disposed between the optical measuring device and the cover member, the first prism being configured to allow the light from the optical measuring device to pass therethrough and deflect an optical path of the light;

a second prism disposed between the optical measuring device and the cover member, the second prism being configured to allow the reflected light from the polishing surface to pass therethrough and deflect an optical path of the reflected light; and a light shielding member disposed between the first prism and the second prism, the light shielding member being configured to block light between the first prism and the second prism, wherein the cover member includes a first cover member configured to allow the light from the optical measuring device to pass therethrough, and the second cover member configured to allow the reflected light from the polishing surface to pass therethrough, and the light shielding member is disposed between the first cover member and the second cover member, and is configured to block light between the first cover member and the second cover member.

15. A surface property measuring method comprising:

rotating a polishing table together with a polishing pad which is supported by the polishing table;

supplying a transparent liquid onto the polishing pad through an inlet port provided in a cover member, the cover member being disposed between an optical measuring device and the polishing pad and having a light transmissive portion; and directing light to a polishing surface of the polishing pad through the light transmissive portion, receiving reflected light from the polishing surface through the light transmissive portion, and measuring a surface property of the polishing pad based on the reflected light by the optical measuring device.

16. The surface property measuring method according to claim 15, wherein the inlet port is located upstream of the light transmissive portion in a rotating direction of the polishing pad.

17. The surface property measuring method according to claim 15, wherein the inlet port is located downstream of the light transmissive portion in a rotating direction of the polishing pad.

18. The surface property measuring method according to claim 15, further comprising regulating a flow rate of the transparent liquid to be supplied onto the polishing pad.

19. The surface property measuring method according to claim 15, further comprising sucking the transparent liquid on the polishing pad through a suction port provided in the cover member, while supplying the transparent liquid onto the polishing pad through the inlet port.

20. The surface property measuring method according to claim 19, further comprising regulating a flow rate of the transparent liquid to be sucked from the polishing pad.

21. The surface property measuring method according to claim 15, wherein the cover member has a facing surface parallel to the polishing surface of the polishing pad.

22. The surface property measuring method according to claim 21, wherein a distance from the polishing surface of the polishing pad to the facing surface is 5 mm or less.

23. The surface property measuring method according to claim 15, further comprising adjusting a height of the cover member with respect to the polishing surface.

24. The surface property measuring method according to claim 15, further comprising generating an image of a monitoring region including a measurement point on the polishing surface where the light is applied and the light is reflected.

25. The surface property measuring method according to claim 24, further comprising regulating a flow rate of the transparent liquid to be supplied onto the polishing pad based on the image of the monitoring region.

26. The surface property measuring method according to claim 25, further comprising:

sucking the transparent liquid on the polishing pad through a suction port provided in the cover member, while supplying the transparent liquid onto the polishing pad through the inlet port; and regulating a flow rate of the transparent liquid to be sucked from the polishing pad based on the image of the monitoring region.

27. The surface property measuring method according to claim 25, further comprising generating an alarm when an abnormality in a flow of the transparent liquid on the polishing pad is detected based on the image of the monitoring region.

28. A polishing method comprising:

polishing a substrate with use of a polishing pad; and measuring a surface property of the polishing pad by the surface property measuring method according to claim 15, and determining whether the polishing pad has reached a replacement time based on a measurement result of the surface property.

29. A polishing method comprising:

supporting a new polishing pad by a polishing table;

polishing a break-in substrate to perform a break-in process of the new polishing pad;

measuring a surface property of the new polishing pad by the surface property measuring method according to according to claim 15;

determining whether the break-in process is completed based on a measurement result of the surface property; and polishing a substrate with use of the new polishing pad when it has been determined that the break-in process is completed.

* * * * *